US008264510B2

(12) United States Patent
Sowa et al.

(10) Patent No.: US 8,264,510 B2
(45) Date of Patent: Sep. 11, 2012

(54) EXPOSURE HEAD AND IMAGE FORMING APPARATUS

(75) Inventors: Takeshi Sowa, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 170 days.

(21) Appl. No.: 12/818,129

(22) Filed: Jun. 17, 2010

(65) Prior Publication Data

US 2010/0321462 A1 Dec. 23, 2010

(30) Foreign Application Priority Data

Jun. 22, 2009 (JP) ..... 2009-147862

(51) Int. Cl.

| | |
|---|---|
| ***B41J 2/385*** | (2006.01) |
| ***B41J 2/455*** | (2006.01) |
| ***B41J 2/45*** | (2006.01) |
| ***B41J 15/14*** | (2006.01) |

(52) U.S. Cl. ..... 347/137; 347/130; 347/134; 347/233; 347/238; 347/241; 347/244

(58) Field of Classification Search ..... None
See application file for complete search history.

(56) References Cited

U.S. PATENT DOCUMENTS

| | | | | |
|---|---|---|---|---|
| 2006/0092263 | A1* | 5/2006 | Tsujino et al. | 347/224 |
| 2008/0030566 | A1 | 2/2008 | Nomura et al. | |
| 2008/0225108 | A1* | 9/2008 | Koizumi et al. | 347/244 |

FOREIGN PATENT DOCUMENTS

| | | | |
|---|---|---|---|
| JP | 10-237439 | A | 9/1998 |
| JP | 2008-036937 | A | 2/2008 |

* cited by examiner

*Primary Examiner* — Matthew Luu
*Assistant Examiner* — Kendrick Liu
(74) *Attorney, Agent, or Firm* — Kilpatrick Townsend & Stockton LLP

(57) ABSTRACT

An image forming apparatus includes an image carrier having a curvature in a first direction; and an exposure head including a first light emitting element that emits a light having a wavelength λ11 and a light having a wavelength λ12, a first optical system that converges each of the light emitted from the first light emitting element onto the image carrier, a second light emitting element, and a second optical system that converges a light emitted from the second light emitting element onto the image carrier, wherein a position at which the first optical system converges each of the light and a position at which the second optical system converges the light are different from each other with respect to the first direction.

8 Claims, 21 Drawing Sheets

FIG. 15

| SURFACE NUMBER | DESCRIPTION | MAIN SECTION CENTER CURVATURE | DISTANCE BETWEEN SURFACES | INDEX OF REFRACTION | ABBE NUMBER |
|---|---|---|---|---|---|
| S1 | LIGHT SOURCE SURFACE | r1 = ∞ | d1 = 0.5 | Nd = 1.5168 | νd = 64.17 |
| S2 | GLASS BASE MATERIAL EXIT SURFACE | r2 = ∞ | d2 = 2.4685 | | |
| S3 | APERTURE DIAPHRAGM | r3 = ∞ | d3 = 0.0475 | | |
| S4 | LENS RESIN PORTION INCIDENCE SURFACE | r4 = (SURFACE SHAPE DESCRIBED IN FIG. 16) | d4 = 0.33 | Nd = 1.5085 | νd = 30.0 |
| S5 | RESIN-GLASS INTERFACE | r5 = ∞ | d5 = 0.5 | Nd = 1.5410 | νd = 57.0 |
| S6 | LENS EXIT SURFACE | r6 = ∞ | d6 = 1.3232 | | |
| S7 | LENS RESIN PORTION INCIDENCE SURFACE | r7 = (SURFACE SHAPE DESCRIBED IN FIG. 17) | d7 = 0.36 | Nd = 1.5085 | νd = 30.0 |
| S8 | RESIN-GLASS INTERFACE | r8 = ∞ | d8 = 0.9 | Nd = 1.5410 | νd = 57.0 |
| S9 | LENS EXIT SURFACE | r9 = ∞ | d9 = 0.95 | | |
| S10 | IMAGE SURFACE | r10 = ∞ | | | |

FIG. 16

SHAPE OF S4 LENS SURFACE

DEFINITION FORMULA (POLYNOMIAL IN X AND Y)

$$\frac{cr^2}{1+\sqrt{1-(1+K)c^2r^2}}+Ax^2+By^2+Cx^4+Dx^2y^2+Ey^4+Fx^6+Gx^4y^2+Hx^2y^4+Iy^6$$

WHERE $r^2=x^2+y^2$ x: COORDINATE IN MAIN DIRECTION
y: COORDINATE IN SUB-DIRECTION
c: CURVATURE ON OPTICAL AXIS
K: CONIC CONSTANT
A TO I: ASPHERIC CONSTANT

VALUE OF COEFFICIENTS $c=1/1.1987943$, $K=-0.9919229$,
$A=0.0$, $B=0.02142000$, $C=-0.003610802$,
$D=-0.007315445$, $E=-0.01034559$, $F=-0.007311870$,
$G=-0.03376912$, $H=-0.002306481$, $I=-0.005116244$

FIG. 17

SHAPE OF S7 LENS SURFACE

DEFINITION FORMULA (POLYNOMIAL IN X AND Y)

$$\frac{cr^2}{1+\sqrt{1-(1+K)c^2r^2}}+Ax^2+By^2+Cx^4+Dx^2y^2+Ey^4+Fx^6+Gx^4y^2+Hx^2y^4+Iy^6$$

WHERE $r^2=x^2+y^2$ x: COORDINATE IN MAIN DIRECTION
y: COORDINATE IN SUB-DIRECTION
c: CURVATURE ON OPTICAL AXIS
K: CONIC CONSTANT
A TO I: ASPHERIC CONSTANT

VALUE OF COEFFICIENTS $c=1/1.0518036$, $K=-0.9888247$,
$A=0.0$, $B=-0.03011342$, $C=-0.008307260$,
$D=-0.05876944$, $E=-0.05396118$, $F=-0.05943258$,
$G=-0.20231997$, $H=-0.2300925$, $I=0.008794010$

SPECIFICATIONS OF OPTICAL SYSTEM

| | |
|---|---|
| OBJECT-SIDE ANGULAR APERTURE (HALF ANGLE) | 12.6 deg |
| IMAGE-SIDE ANGULAR APERTURE (HALF ANGLE) u | 17.6 deg |
| WIDTH OF OBJECT-SIDE PIXEL GROUP IN MAIN DIRECTION Wm | 0.885 mm |
| WIDTH OF OBJECT-SIDE PIXEL GROUP IN SUB-DIRECTION Ws | 0.150 mm |
| MAGNIFICATION m | −0.7056 |
| DIAMETER OF LIGHT-EMITTING ELEMENT (DIAMETER OF LIGHT SOURCE) D | 28.6 μm |

SPOT DIAMETER IN MAIN DIRECTION

EXPOSURE HEAD AND IMAGE FORMING APPARATUS

BACKGROUND

1. Technical Field

The present invention relates to an exposure head that exposes an exposure surface or an image carrier having a curvature by converging light emitted from light emitting elements onto the exposure surface or the image carrier. The invention also relates to an image forming apparatus including the exposure head.

2. Related Art

Exposure heads that expose an exposure surface by converging light emitted from light emitting elements onto the exposure surface using an optical system have been known. Exposure heads have been generally used to expose an exposure surface having a curvature, such as a peripheral surface of a photosensitive drum (image carrier). JP-A-2008-036937 discloses an exposure head (a "line head" in the Publication) including a plurality of optical systems disposed at different positions with respect to a direction in which the exposure surface has a curvature (a "sub-scanning direction" in the Publication). In this exposure head, each the optical systems converges a light emitted from a light emitting element at a position facing the optical system in the optical axis direction.

However, in the aforementioned exposure head, the optical systems converge the light at different positions with respect to the direction in which the exposure surface has a curvature. Therefore, the position at which one optical system converges a light on the exposure surface and the position at which another optical system converges a light on the exposure surface may be displaced from each other with respect to the optical axis direction. As a result, the sizes of converged light formed on the exposure surface by the optical systems may become different from each other. Such a difference between the sizes of the converged light formed by the optical systems may cause a defective and uneven exposure.

SUMMARY

An advantage of some aspects of the invention is that, in an exposure head and an image forming apparatus including the exposure head, the exposure head including a plurality of optical systems that converge light at different positions with respect to a direction in which an exposure surface has a curvature, the aforementioned difference between the sizes of converged light is suppressed and a good exposure is realized.

An image forming apparatus according to an aspect of the invention includes an image carrier having a curvature in a first direction; and an exposure head including a first light emitting element that emits a light having a wavelength $\lambda 11$ and a light having a wavelength $\lambda 12$, a first optical system that converges each of the light emitted from the first light emitting element onto the image carrier, a second light emitting element, and a second optical system that converges a light emitted from the second light emitting element onto the image carrier, wherein a position at which the first optical system converges each of the light and a position at which the second optical system converges the light are different from each other with respect to the first direction, wherein the first optical system focuses the light having the wavelength $\lambda 11$ at an imaging position P11 and focuses the light having the wavelength $\lambda 12$ at an imaging position P12, the imaging position P11 and the imaging position P12 being different from each other with respect to an optical axis direction of the first optical system, and wherein a distance $\Delta 1$ between the imaging position P11 and the imaging position P12 with respect to the optical axis direction of the first optical system is equal to or larger than a distance d between an intersection point I1 and an intersection point I2 with respect to the optical axis direction of the first optical system, the intersection point I1 being a point at which the optical axis of the first optical system intersects the image carrier, the intersection point I2 being a point at which an optical axis of the second optical system intersects the image carrier.

An exposure head according to another aspect of the invention includes a first light emitting element that emits a light having a wavelength $\lambda 11$ and a light having a wavelength $\lambda 12$; a first optical system that converges each of the light emitted from the first light emitting element onto an exposure surface having a curvature in a first direction; a second light emitting element; and a second optical system that converges a light emitted from the second light emitting element onto the exposure surface, wherein a position at which the first optical system converges each of the light and a position at which second optical system converges the light are different from each other with respect to the first direction, wherein the first optical system focuses the light having the wavelength $\lambda 11$ at an imaging position P11 and focuses the light having the wavelength $\lambda 12$ at an imaging position P12, the imaging position P11 and the imaging position P12 being different from each other with respect to an optical axis direction of the first optical system, and wherein a distance $\Delta 1$ between the imaging position P11 and the imaging position P12 with respect to the optical axis direction of the first optical system is equal to or larger than a distance d between an intersection point I1 and an intersection point I2 with respect to the optical axis direction of the first optical system, the intersection point I1 being a point at which the optical axis of the first optical system intersects the exposure surface, the intersection point I2 being a point at which an optical axis of the second optical system intersects the exposure surface.

In the image forming apparatus and the exposure head, the first optical system and the second optical system converge light onto an image carrier (exposure surface) having a curvature in the first direction. The position at which the first optical system converges the light on the surface of the image carrier surface and the position at which the second optical system converges the light on the surface of the image carrier are different from each other with respect to the first direction. Thus, the position of the converged light formed by the first optical system on the surface of the image carrier and the position of the converged light formed by the second optical system on the surface of the image carrier are displaced from each other in the optical axis direction. As a result, the sizes of the converged light formed by these optical systems may become different from each other.

The image forming apparatus and the exposure head according to aspects of the invention includes the first light emitting element that emits a light having a wavelength $\lambda 11$ and a light having a wavelength $\lambda 12$. The first optical system focuses the light having the wavelength $\lambda 11$ at the imaging position P11 and focuses the light having the wavelength $\lambda 12$ at the imaging position P12, the imaging position P11 and the imaging position P12 being different from each other with respect to the imaging position P12. That is, the first optical system focuses the light from the first light emitting element at the imaging positions P11 and P12, which are separated from each other by the distance $\Delta 1$ in the optical axis direction. As a result, an effect is obtained in that the apparent depth of focus of the first optical system is increased. The distance $\Delta 1$ is equal to or larger than the distance d, which is a distance between the intersection point IS1, at which the optical axis of the first optical system intersects the image carrier (exposure surface), and the intersection point IS2, at which the optical axis of the second optical system intersects the surface of the image carrier (exposure surface), in the optical axis direction. Therefore, the apparent depth of focus of the first optical system can be made sufficiently larger than the displacement between the position of converged light formed by the first optical system and the position of the converged light formed by the second optical system, so that the difference between the sizes of the converged light is suppressed and an even and good exposure can be realized.

It is preferable that the first light emitting element have an emission spectrum having peaks at the wavelength λ11 and at the wavelength λ12. In this case, the apparent depth of focus is efficiently increased, whereby a better exposure can be realized.

According to the aspects of the invention, the distance Δ1 between the imaging position P11 and the imaging position P12 of the first optical system in the optical axis direction is equal to or larger than the distance d, whereby an advantage is obtained in that the difference in the sizes of the converged light formed by the first optical system and the second optical system is suppressed. However, if the distance Δ1 is too large, aberration of the converged light increases and the imaging performance deteriorates, so that an uneven exposure or a decrease in the resolution may occur. It is preferable that the image forming apparatus include an aperture diaphragm disposed in the first optical system, and an expression $$\Delta 1 \leqq |m| \times D/\tan(u)$$

be satisfied, where D is a diameter of the first light emitting element with respect to a second direction that is perpendicular to the first direction, m is a magnification of the first optical system with respect to the second direction, and u is an image-side angular aperture that is half an angle between two lines connecting an image point of the first optical system and ends of a diameter of an entrance pupil. In this case, influence on the imaging performance such as aberration can be suppressed, so that a better exposure can be realized.

As with the first optical system, the apparent depth of focus of the second optical system may be increased. That is, it is preferable that the second light emitting element emit a light having a wavelength λ21 and a light having a wavelength λ22, the second optical system focus the light having the wavelength λ21 at an imaging position P21 and focus the light having the wavelength λ22 at an imaging position P22, the imaging position P21 and the imaging position P22 being different from each other with respect to the optical axis direction of the second optical system, and a distance Δ2 between the imaging position P21 and the imaging position P22 with respect to the optical axis direction of the second optical system be equal to or larger than the distance d. In this case, the apparent depth of focus of the second optical system can be made sufficiently larger than the displacement between the converged light formed by the first optical system and the converged light formed by the second optical system in the optical axis direction. By making the apparent depths of focus of the first optical system and the second optical system sufficiently larger than the displacement between the converged light formed by the first and the second optical systems, the difference in the sizes of the converged light formed by these optical systems can be more reliably suppressed, so that a better exposure can be realized.

It is preferable that three or more optical systems including the first optical system and the second optical system be arranged in the first direction, the three or more optical system converging light at different positions with respect to the first direction. With this structure, there is a large difference between the imaging point of the optical system having an optical axis that is farthest from the center of curvature of the image carrier and the imaging position of the optical system having an optical axis that is nearest to the center of curvature of the image carrier in the optical axis direction. The difference in the sizes of the converged light is significant between these optical systems. Therefore, it is preferable that one of the optical axis of the first optical system and the optical axis of the second optical system be nearest to a center of curvature of the image carrier among optical axes of the three or more optical systems, and the other of the optical axis of the first optical system and the optical axis of the second optical system be farthest from the center of curvature of the image carrier among the optical axes of the three or more optical systems. In this case, the difference in the sizes of the converged light between the optical system having an optical axis that is farthest from the center of curvature of the image carrier and the imaging position of the optical system having an optical axis that is nearest to the center of curvature is suppressed, so that a good exposure can be realized.

As described above, if the distance Δ1 between the imaging position P11 and the imaging position P12 in the optical axis direction of the first optical system is too large, there may be an influence on the imaging performance such as aberration. The influence on the imaging performance such as aberration may be suppressed by decreasing the distance Δ1. For this purpose, it is preferable that the distance d be decreased, because, in this case, the magnitude of the distance Δ1 can be decreased while satisfying the condition that the distance Δ1 is equal to or larger than the distance d. Thus, the following structure may be used.

That is, it is preferable that (2N+2) optical systems (where N is an integer equal to or greater than 1) including the first optical system and the second optical system be arranged in the first direction with a distance therebetween, and the one of the first optical system and the second optical system be located in an (N+1)th or an (N+2)th position from an end of the (2N+2) optical systems. In this case, because the distance d is decreased, the distance Δ1 can be decreased while satisfying the condition that the distance Δ1 is equal to or larger than the distance d, whereby an influence on the imaging performance such as aberration can be easily suppressed.

It is preferable that (2N+1) optical systems (where N is an integer equal to or greater than 1) including the first optical system and the second optical system be arranged in the first direction with a distance therebetween, and the one of the first optical system and the second optical system be located in an (N+1)th position from an end of the (2N+1) optical systems. In this case, because the magnitude of the distance d is limited, the magnitude of the distance Δ1 can be limited while satisfying the condition that the distance Δ1 is equal to or larger than the distance d, whereby an influence on the imaging performance such as aberration can be easily suppressed.

BRIEF DESCRIPTION OF THE DRAWINGS

The invention will be described with reference to the accompanying drawings, wherein like numbers reference like elements.

FIG. 15 is a table of lens data of an optical system used in an example.

FIG. 16 shows summary data about the shape of a S4 surface.

FIG. 17 shows summary data about the shape of a S7 surface.

DESCRIPTION OF EXEMPLARY EMBODIMENTS

As described above, with an exposure head and an image forming apparatus including the exposure head, the exposure head including a plurality of optical systems that converges light at different positions with respect to a direction in which an exposure surface has a curvature, the sizes of the converged light formed by the plurality of optical systems may become different from each other. Hereinafter, the cause of the difference between the sizes of converged light and measures to deal therewith will be first described, and the embodiments will be described in detail.

Figure 1:
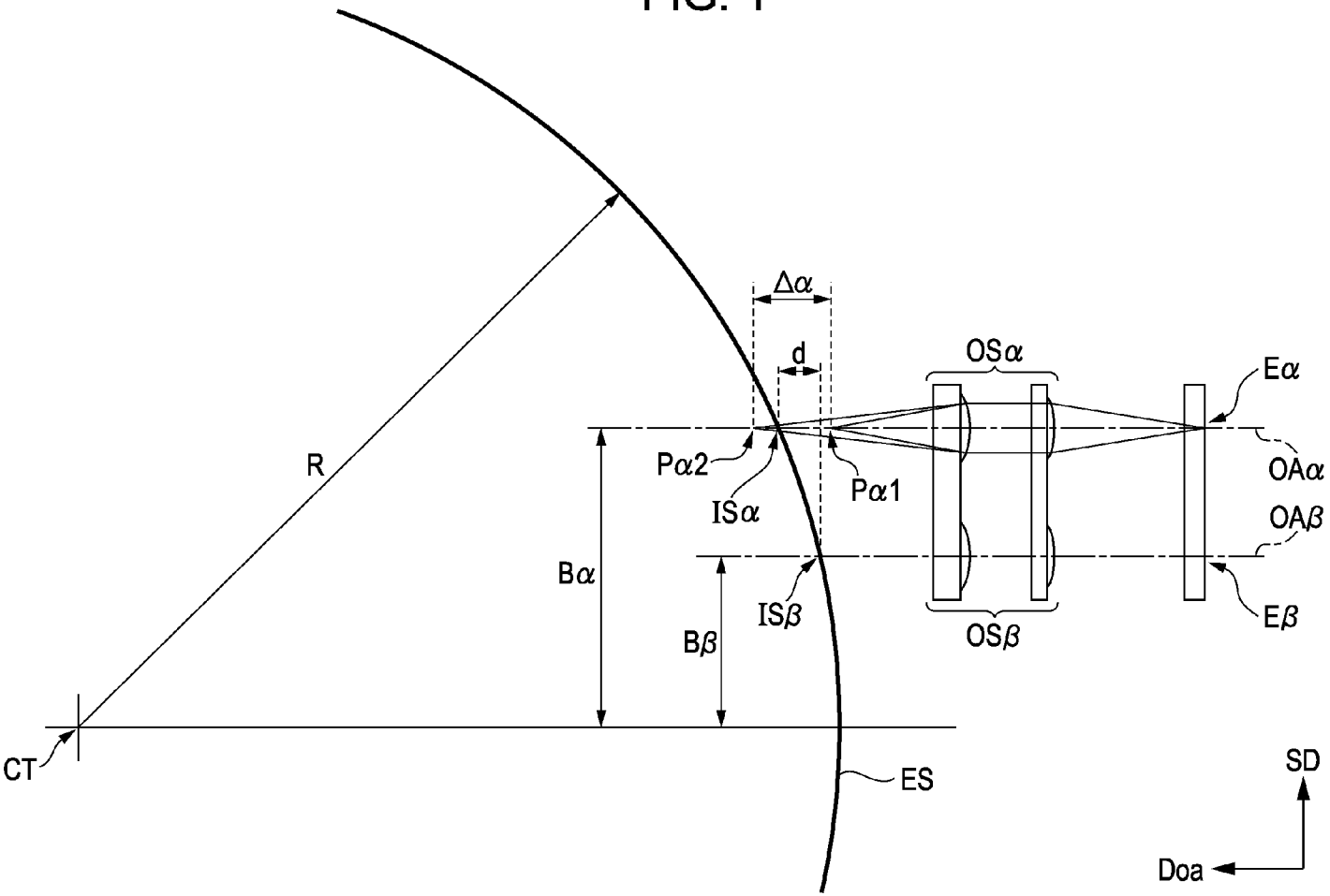
FIG. 1 is a diagram used to describe the cause of a difference between the sizes of converged light and measures to deal therewith.

A. Cause of Difference Between the Sizes of Converged Light and Measures to Deal Therewith FIG. 1 is a diagram used to describe the cause of a difference between the sizes of converged light and measures to deal therewith. FIG. 1 is a view from a main scanning direction MD, which is perpendicular to a sub-scanning direction SD. An exposure surface ES has a finite curvature in the sub-scanning direction SD. In other words, the exposure surface ES has a finite radius of curvature R in a cross section extending in the sub-scanning direction SD. Two optical systems OSα and OSβ are arranged in the sub-scanning direction SD. The optical systems OSα and OSβ converge light at different positions with respect to the sub-scanning direction SD. To be specific, the optical system OSα converges a light emitted from a light emitting element Eα at the vicinity of an intersection point ISα at which an optical axis OAα of the optical system OSα intersects the exposure surface ES. The optical system OSβ converges a light emitted from a light emitting element Eβ at the vicinity of an intersection point ISβ at which an optical axis OAβ of the optical system OSβ intersects the exposure surface ES. With this structure, the position of the converged light formed by the optical system OSα (the vicinity of the intersection point ISα) and the position of the converged light formed by the optical system OSβ (the vicinity of the intersection point ISβ) may be separated from each other by about a distance d in an optical axis direction Doa (a direction parallel to the optical axes OAα and OAβ). As a result, the sizes of the converged light formed by the optical system OSα and the optical system OSβ may become different from each other.

As measures to deal with such a problem, the following structure can be used. In the structure illustrated in FIG. 1, the light emitting element Eα emits a light having a wavelength λα1 and a light having a wavelength λα2. The material of lenses included in the optical system OSα has a property that the index of refraction changes in accordance with the wavelength of a light, whereby the imaging position can be changed in the optical axis direction in accordance with the wavelength of the light. Thus, the optical system OSα focuses the light having the wavelength λα1 at an imaging position Pα1 and focuses the light having the wavelength λα2 at an imaging position Pα2, the imaging positions Pα1 and Pα2 being different from each other with respect to the optical axis direction Doa of the optical system OSα. That is, the optical system OSα focuses the light emitted from the light emitting element Eα at two imaging positions Pα1 and Pα2 that are separated from each other by a distance Δα in the optical axis direction Doa, whereby an effect is obtained in that the apparent depth of focus of the optical system OSα is increased. Moreover, the distance Δα is equal to or larger than a distance d between an intersection point ISα, which is a point at which the optical axis OAα of the optical system OSα intersects the exposure surface ES, and an intersection point ISβ, which is a point at which the optical axis OAβ of the optical system OSβ intersects the exposure surface ES, in the optical axis direction Doa. Therefore, the apparent depth of focus of the optical system OSα can be made sufficiently larger than a displacement between the converged light formed by the optical system OSβ and the converged light formed by the optical system OSα in the optical axis direction Doa, whereby a difference between the sizes of the converged light formed by the optical system OSα and the optical system OSβ can be suppressed and a good exposure is realized.

In the case described above, the apparent depth of focus of the optical system OS1, which is farther from the center of curvature CT of the exposure surface ES, is increased. However, the same advantage can be obtained if the apparent depth of focus of the optical system OS2, which is nearer to the center of curvature CT of the exposure surface ES, is increased (FIG. 2).

Figure 2:
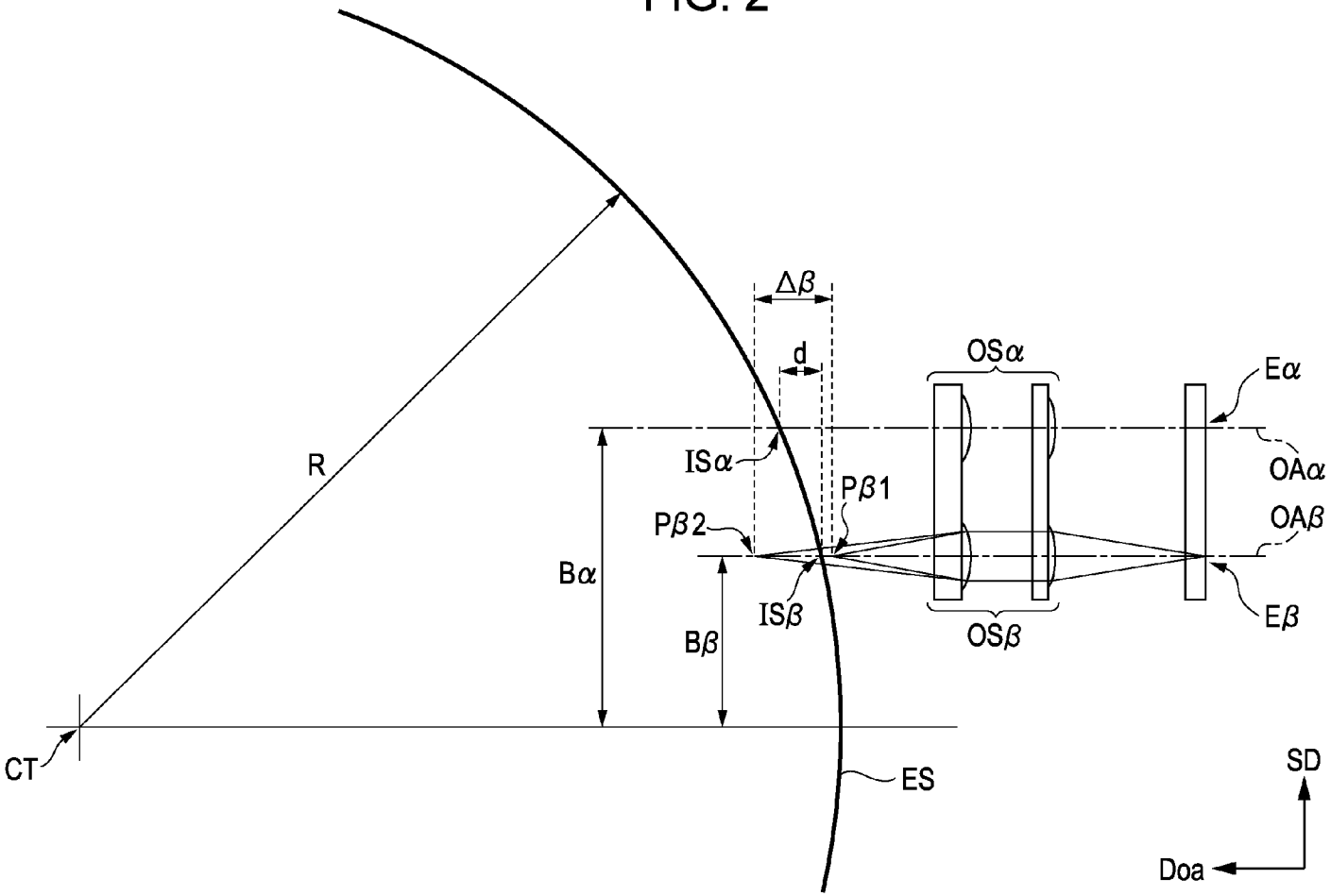
FIG. 2 is another diagram used to describe the cause of a difference between the sizes of converged light and measures to deal therewith.

FIG. 2 is another diagram used to describe the cause of a difference between the sizes of converged light and measures to deal therewith. FIG. 2 is a view from the main scanning direction MD, which is perpendicular to the sub-scanning direction SD. With the structure illustrated in FIG. 2, the light emitting element Eβ emits a light having a wavelength λβ1 and a light having a wavelength λβ2. The optical system OSβ focuses the light having the wavelength λβ1 at an imaging position Pβ1 and focuses the light having the wavelength λ32 at an imaging position Pβ2, the imaging positions Pβ1 and Pβ2 being different from each other with respect to the optical axis direction of the optical system OSβ. That is, the optical system OSβ focuses a light from the light emitting element Eα at two imaging positions Pβ1 and Pβ2 that are separated from each other by a distance Δβ in the optical axis direction Doa, whereby an effect is obtained in that the apparent depth of focus of the optical system OSβ is increased. Moreover, the distance Δβ is equal to or larger than the distance d described above. Therefore, the apparent depth of focus of the optical system OSβ can be made sufficiently larger than the displacement between the converged light formed by the optical system OSα and the converged light formed by the optical system OSβ in the optical axis direction Doa, whereby a difference between the sizes of the converged light formed by the optical system OSα and the size of the converged light formed by the optical system OSβ can be suppressed, whereby a good exposure is realized.

The distance d can be calculated from the following expression $$d=(R^2-B\beta^2)^{1/2}-(R^2-B\alpha^2)^{1/2}) \quad \text{(expression 1)},$$

where R is the radius of curvature of the exposure surface ES, Bα is the distance between the optical axis OAα of the optical system OSα and the center of curvature CT of the exposure surface ES, and Bβ is the distance between the optical axis OAβ of the optical system OSβ and the center of curvature CT of the exposure surface ES. The distance between an optical axis and the center of curvature is the distance between the optical axis and a line that is parallel to the optical axis and passes through the center of curvature.

The optical axis of an optical system will be described before describing the embodiments. The optical axis of an optical system can be obtained as follows. When an optical system is symmetric (mirror symmetric) with respect to a plane perpendicular to the sub-scanning direction SD (first direction) and symmetric (mirror symmetric) with respect to a plane perpendicular to the main scanning direction MD (second direction), the optical system has a first symmetry plane that is perpendicular to the first direction and has a second symmetry plane that is perpendicular to the second direction. The optical axis can be obtained as the intersection of the first symmetry plane and the second symmetry plane. In particular, if the optical system is rotationally symmetric, the intersection of the first symmetry plane and the second symmetry plane coincides with the axis of rotational symmetry, and the optical axis can be obtained as this axis of rotational symmetry.

B-1. First Embodiment

Figure 3:
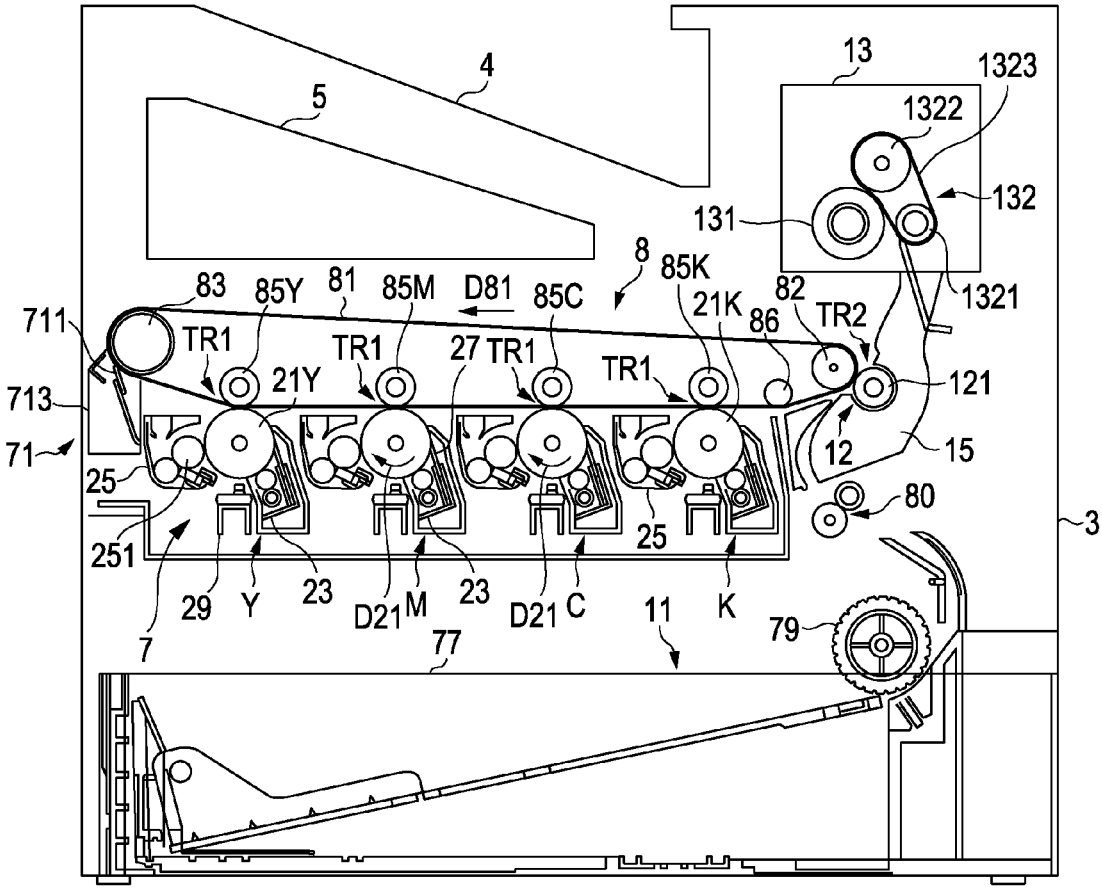
FIG. 3 is a diagram illustrating an example of an image forming apparatus to which the invention can be applied.
Figure 4:
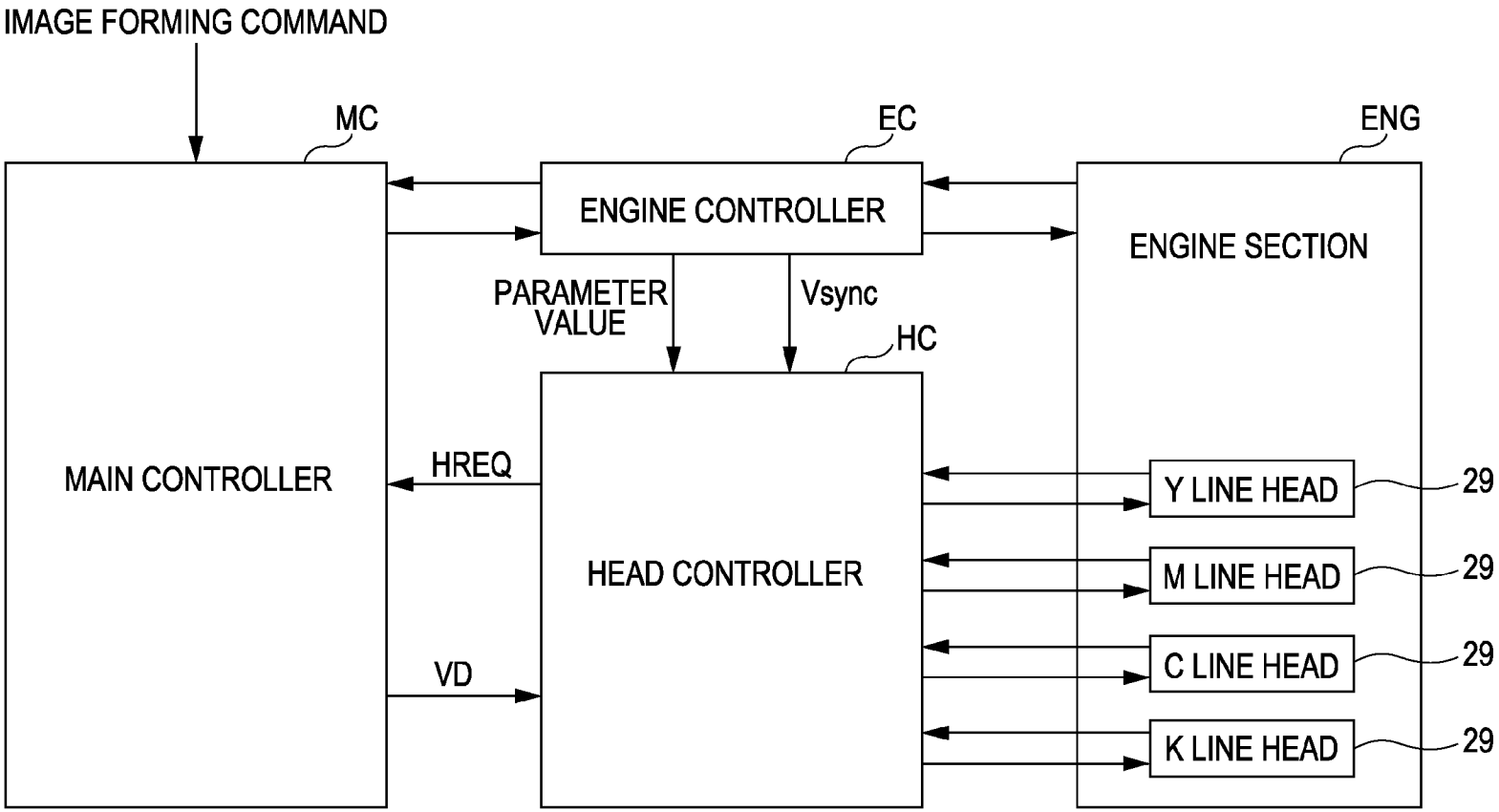
FIG. 4 is a block diagram of the electrical structure of the image forming apparatus illustrated in FIG. 3.

FIG. 3 is a diagram illustrating an example of an image forming apparatus to which the invention can be applied. FIG. 4 is a block diagram of the electrical structure of the image forming apparatus illustrated in FIG. 3. The image forming apparatus can selectively perform a color mode or a monochrome mode. In the color mode, a color image is formed by overlaying toners of four colors: black (K), cyan (C), magenta (M), and yellow (Y). In the monochrome mode, a monochrome image is formed using only the black (K) toner. FIG. 3 illustrates the image forming apparatus when performing the color mode. In the image forming apparatus, when an image forming command is supplied by an external apparatus such as a host computer to a main controller MC, which includes a CPU and a memory, the main controller MC supplies a control signal and the like to an engine controller EC and supplies video data VD corresponding to the image forming command to a head controller HC. At this time, the main controller MC supplies the head controller HC with the video data VD for one line extending in the main scanning direction MD every time the main controller MC receives a horizontal request signal HREQ from the head controller HC. The head controller HC controls line heads 29 for the four colors on the basis of the video data VD, which is supplied by the main controller MC, a vertical synchronizing signal Vsync, which is supplied by the engine controller EC, and a parameter value. Thus, an engine section ENG performs a predetermined image forming operation, so that an image corresponding to the image forming command is formed on a sheet of tracing paper, transfer paper, form, or OHP transparency.

An electrical component box 5, which is disposed in a housing body 3 of the image forming apparatus, contains a power circuit substrate, the main controller MC, the engine controller EC, and the head controller HC. An image forming unit 7, a transfer belt unit 8, and a sheet feed unit 11 are disposed in the housing body 3. A secondary transfer unit 12, a fixing unit 13, and a sheet guide 15 are disposed on the right side of the housing body 3 in FIG. 3. The sheet feed unit 11 is removably attached to the apparatus body 1. The sheet feed unit 11 and the transfer belt unit 8 can be removed for repair or for replacement.

The image forming unit 7 includes four image forming stations Y (yellow), M (magenta), C (cyan), and K (black), each forming an image of a corresponding color. Each of the image forming stations Y, M, C, and K includes a photosensitive drum 21 having a cylindrical shape and having a surface with a predetermined length in the main scanning direction MD. Each of the image forming stations Y, M, C, and K forms a toner image of a corresponding color on the surface of the photosensitive drum 21. The photosensitive drums 21 is disposed in such a manner that the axis thereof extends in a direction parallel to or substantially parallel to the main scanning direction MD. Each of the photosensitive drums 21 is connected to a dedicated drive motor that rotates the photosensitive drum 21 at a predetermined speed in a direction indicated by an arrow D21 in FIG. 3. Thus, the surface of the photosensitive drum 21 is moved in the sub-scanning direction SD that is perpendicular to or substantially perpendicular to the main scanning direction MD. Around the photosensitive drum 21, a charger 23, the line head 29, a developing section 25, and a photosensitive-body cleaner 27 are arranged in the rotation direction. These operation sections perform charging, forming of a latent image, and developing of toner. In the color mode, a color image is formed by overlaying toner images, which have been formed by the image forming stations Y, M, C, and K, on a transfer belt 81 included in the transfer belt unit 8. In the monochrome mode, a monochrome image is formed with a toner image formed by the image forming station K. In FIG. 3, for convenience of drawing, numerals are attached to only some of the image forming stations and omitted for the rest, because the image forming stations of the image forming unit 7 have the same structure.

The charger 23 includes a charging roller having a surface made of elastic rubber. The charging roller rotates while being in contact with the surface of the photosensitive drum 21 at a charging position. As the photosensitive drum 21 rotates, the charging roller is rotated by the photosensitive drum 21 in a driven direction at a peripheral speed. The charging roller is connected to a charge bias generator (not shown). The charging roller, which is supplied with a charge bias from the bias generator, charges the surface of the photosensitive drum 21 at the charging position at which the charger 23 contacts the photosensitive drum 21.

The line head 29 is disposed at a distance from the photosensitive drum 21. The longitudinal direction of the line head 29 is parallel to or substantially parallel to the main scanning direction MD. The lateral direction of the line head 29 is parallel to or substantially parallel to the sub-scanning direction SD. The line head 29 includes a plurality of light emitting elements, and each of the light emitting elements emits a light in accordance with the video data VD supplied by the head controller HC. The charged surface of the photosensitive drum 21 is irradiated with the light emitted from the light emitting elements, whereby an electrostatic latent image is formed on the surface of the photosensitive drum 21.

The developing section 25 includes a development roller 251 having a surface for bearing toner thereon. The development roller 251 is electrically connected to a development bias generator (not shown) that applies a development bias to the development roller 251. The developing bias moves the charged toner from the development roller 251 to the photosensitive drum 21 at the development position at which the development roller 251 contacts the photosensitive drum 21. Thus, the electrostatic latent image, which has been formed by the line head 29, is developed.

The toner image, which has been developed at the development position, is transported in the rotation direction D21 of the photosensitive drum 21. Subsequently, the toner image is primarily transferred to the transfer belt 81 at a primary transfer position TR1 at which the transfer belt 81 contacts the photosensitive drum 21.

In the embodiment, the photosensitive-body cleaner 27, which contacts the surface of the photosensitive drum 21, is disposed downstream of the primary transfer position TR1 and upstream of the charger 23 with respect to the rotation direction D21 of the photosensitive drum 21. The photosensitive-body cleaner 27 contacts the surface of the photosensitive drum 21 and removes residual toner remaining on the surface of the photosensitive drum 21 after the primary transfer.

The transfer belt unit 8 includes a drive roller 82, a driven roller 83 (blade facing roller), which is disposed on the left side of the drive roller 82 in FIG. 3, and the transfer belt 81, which is looped over these rollers and rotated in a direction (transport direction) indicated by an arrow D81 in FIG. 3. The transfer belt unit 8 includes four primary transfer rollers 85Y, 85M, 85C, and 85K disposed on the inner side of the transfer belt 81. The primary transfer rollers 85Y, 85M, 85C, and 85K respectively face the photosensitive drums 21 of the image forming stations Y, M, C, and K when the photosensitive cartridge is mounted. Each of the primary transfer rollers 85 is electrically connected to a primary transfer bias generator (not shown). As illustrated in FIG. 3, in the color mode, all primary transfer rollers 85Y, 85M, 85C, and 85K are located adjacent to the image forming stations Y, M, C, and K so that the transfer belt 81 is pressed against the photosensitive drums 21 of the image forming stations Y, M, C, and K. Thus, the primary transfer position TR1 is formed between each of the photosensitive drum 21 and the transfer belt 81. The primary transfer bias generator applies a primary transfer bias to the primary transfer roller 85 at an appropriate time, so that a toner image formed on the surface of each photosensitive drum 21 is transferred to the transfer belt 81 at the corresponding primary transfer position TR1. As a result, a color image is formed.

On the other hand, in the monochrome mode, the color primary transfer rollers 85Y, 85M, and 85C are separated from the image forming stations Y, M, and C respectively facing them. Only the monochrome primary transfer roller 85K is located adjacent to the image forming station K, so that only the monochrome image forming station K contacts the transfer belt 81. As a result, the primary transfer position TR1 is formed only between the monochrome primary transfer roller 85K and the image forming station K. The primary transfer bias generator applies a primary transfer bias to the primary transfer roller 85K at an appropriate time, so that a toner image formed on the surface of a photosensitive drum 21K is transferred to the transfer belt 81 at the primary transfer position TR1. As a result, a monochrome image is formed.

The transfer belt unit 8 includes a downstream guide roller 86 that is disposed downstream of the monochrome primary transfer roller 85K and upstream of the drive roller 82. The downstream guide roller 86 contacts the transfer belt 81 at a position on an internal common tangent line formed by the monochrome primary transfer roller 85K and the photosensitive drum 21K of the image forming station K at the primary transfer position TR1 at which the monochrome primary transfer roller 85K and the photosensitive drum 21K contact each other.

The drive roller 82 rotates the transfer belt 81 in the direction indicated by the arrow D81 and also serves as a backup roller of the secondary transfer roller 121. The peripheral surface of the drive roller 82 is covered with a rubber layer having a thickness of about 3 mm and a volume resistivity lower than 1000 kΩcm. The rubber layer is grounded through a metal shaft and serves as a conductive path of a secondary transfer bias that is supplied by the secondary transfer bias generator (not shown) through the secondary transfer roller 121. By forming the rubber layer, which has high friction and shock absorption, on the drive roller 82, transmission of an impact that occurs when a sheet enters a contact portion (secondary transfer position TR2) between the drive roller 82 and a secondary transfer roller 121 to the transfer belt 81 is suppressed, whereby degradation of the quality of an image can be prevented.

The sheet feed unit 11 includes a sheet feed cassette 77, which can hold a stack of sheets, and a sheet feed section that includes a pickup roller 79 that feeds the sheets one by one from the sheet feed cassette 77. When a sheet is fed from the sheet feed section by the pickup roller 79, a pair of registration rollers 80 adjust timing to feed the sheet, and the sheet is fed to the secondary transfer position TR2 along the sheet guide 15.

The secondary transfer roller 121 can be made to contact or to be separated from the transfer belt 81, driven by a secondary transfer roller drive mechanism (not shown). The fixing unit 13 includes a heating roller 131 and a pressure section 132. The heating roller 131 is rotatable and includes a heating element such as a halogen heater. The pressure section 132 presses and urges the heating roller 131. The sheet guide 15 guides the sheet, on which an image has been secondarily transferred, to a nip portion formed between the heating roller 131 and a pressure belt 1323 of the pressure section 132. An image is thermally fixed at the nip portion at a predetermined temperature. The pressure section 132 includes two rollers 1321 and 1322 and the pressure belt 1323 looped over the two rollers. A surface of the pressure belt 1323 extending between the rollers 1321 and 1322 is pressed against the peripheral surface of the heating roller 131 so as to enlarge the nip portion between the heating roller 131 and the pressure belt 1323. The sheet, that has been subjected the fixing operation, is transported to an output tray 4 disposed on an upper surface of the housing body 3.

This apparatus includes a cleaner section 71 that faces the blade facing roller 83. The cleaner section 71 includes a cleaner blade 711 and a waste toner box 713. An edge of the cleaner blade 711 contacts the blade facing roller 83 with the transfer belt 81 therebetween so as to remove foreign substances, such as residual toner and paper dust, which remain on the transfer belt 81 after the secondary transfer. The foreign substances that have been removed are recovered in the waste toner box 713.

Figure 5:
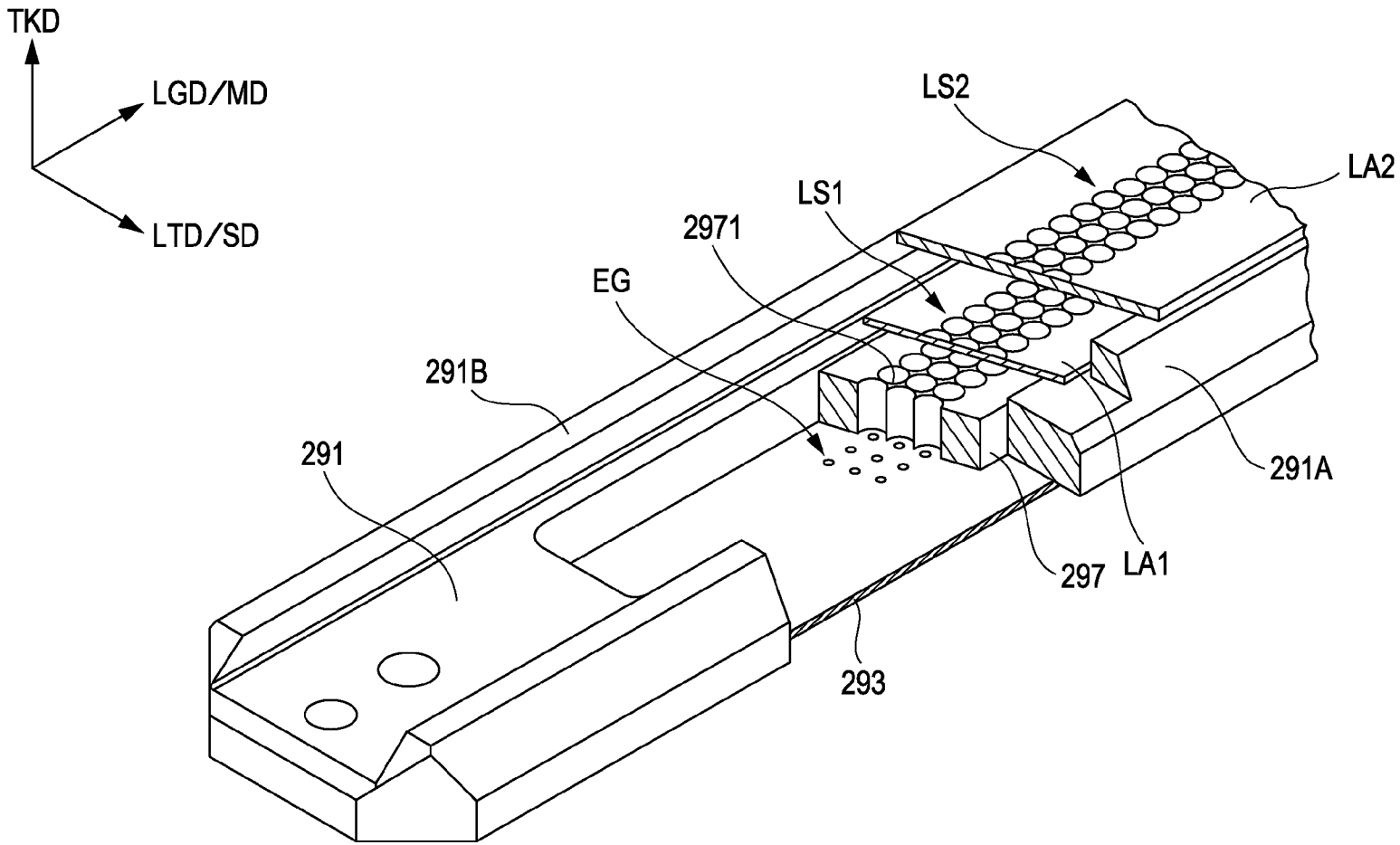
FIG. 5 is a schematic perspective view of a line head.
Figure 6:
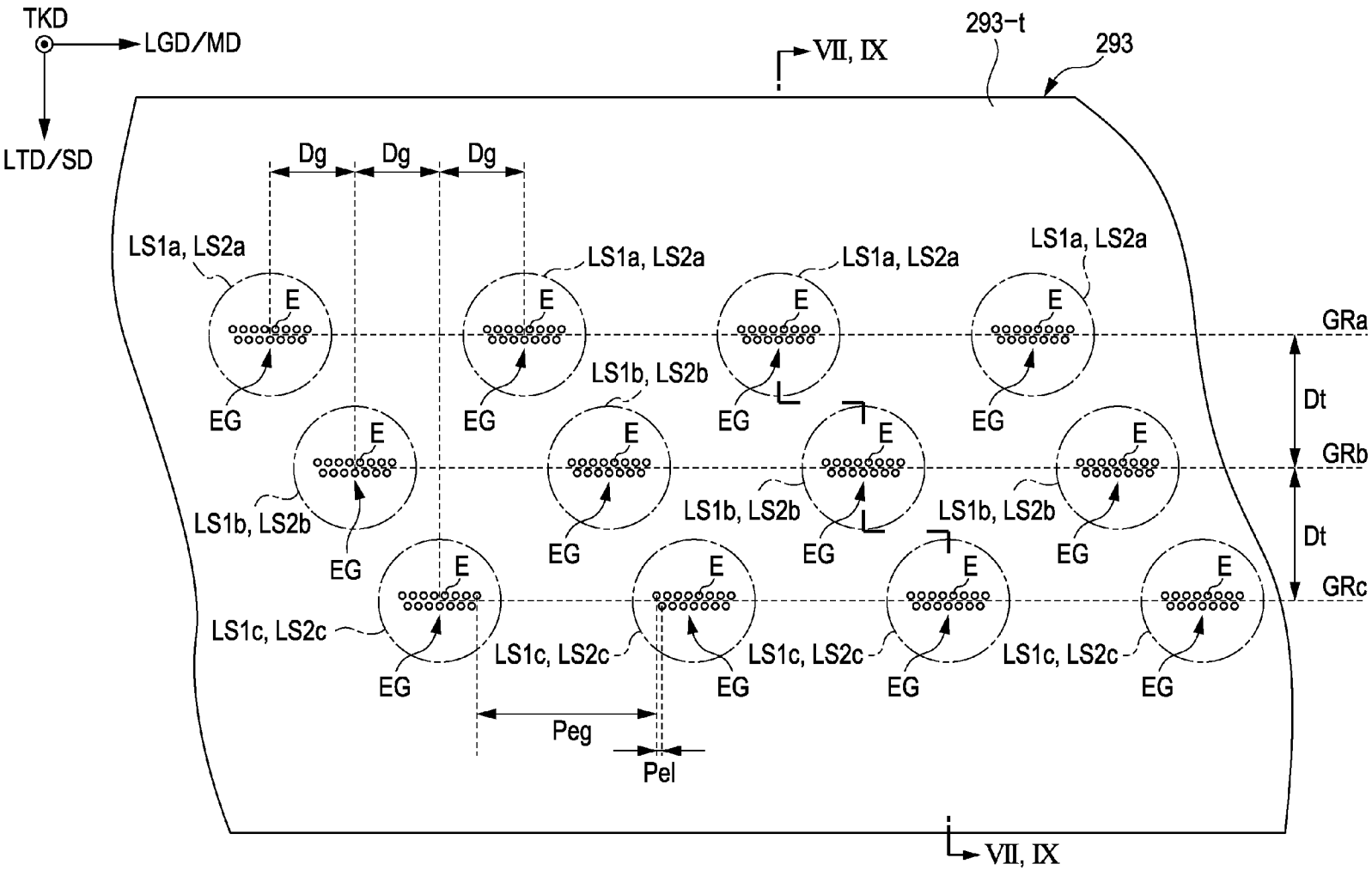
FIG. 6 is a plan view of a head substrate viewed from the thickness direction.
Figure 7:
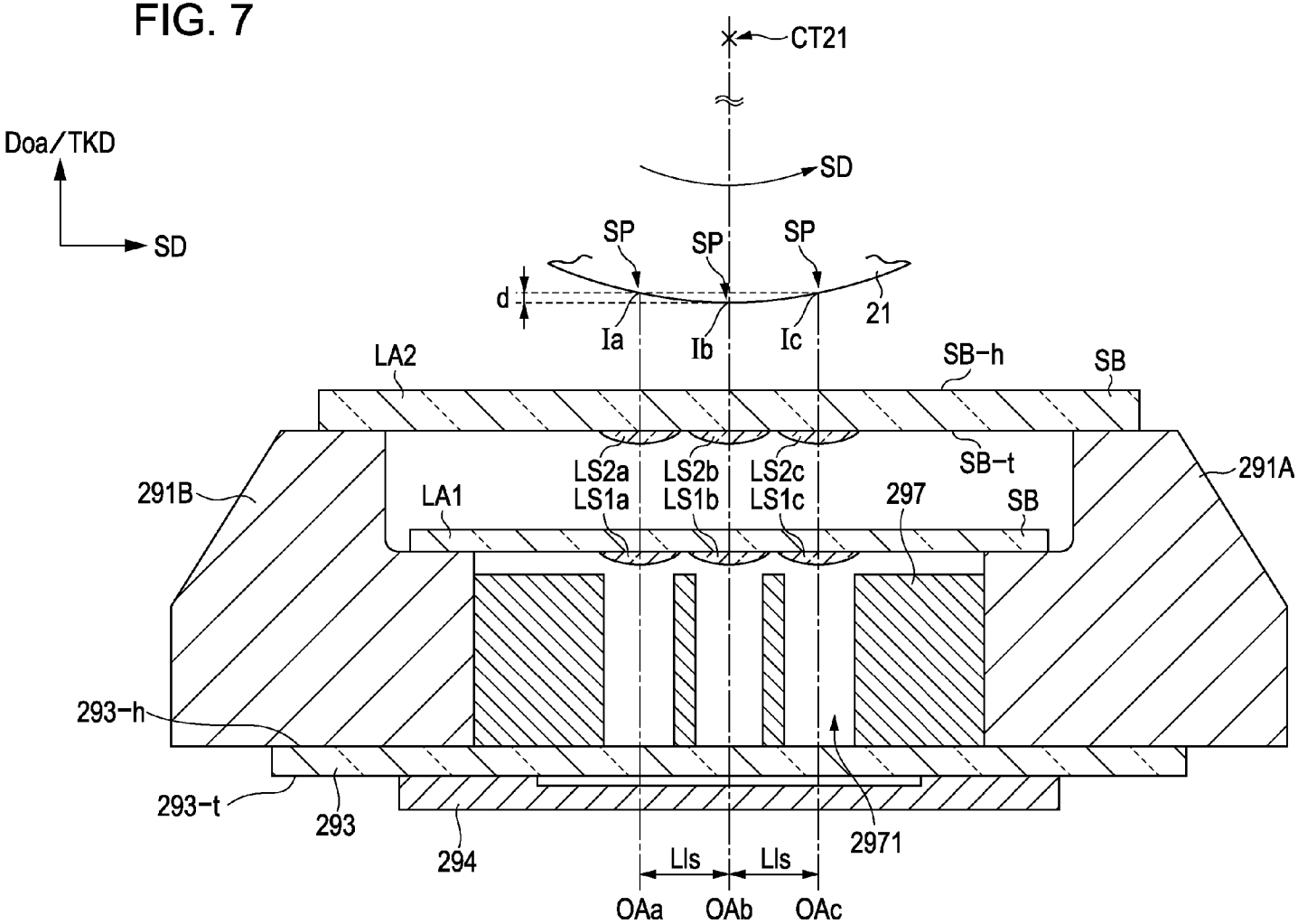
FIG. 7 is a stepped sectional view of a line head of a first embodiment taken along line VII,IX-VII,IX of FIG. 6.

FIG. 5 is a schematic perspective view of a line head. In FIG. 5, a part the line head 29 is illustrated in a cross section in order to facilitate understanding of the structure of the line head 29 in the thickness direction TKD. The thickness direction TKD is perpendicular to or substantially perpendicular to the longitudinal direction LGD and the lateral direction LTD. Light emitting elements E (described below) emit light in the thickness direction TKD (that is, from the line head 29 toward the photosensitive drum 21). The line head 29 includes a head frame 291 extending in the longitudinal direction LGD. A first lens array LA1 and a second lens array LA2 are supported on one side of the head frame 291 in the thickness direction TKD. A head substrate 293 is supported on the other side of the head frame 291 in the thickness direction TKD. A light blocking member 297 is disposed in the head frame 291. Thus, the line head 29 includes the head substrate 293, the light blocking member 297, the first lens array LA1, and the second lens array LA2 that are arranged in this order in the thickness direction TKD. Referring to FIGS. 5 to 7, details of the components will be described. In the description of the embodiment, the downstream side with respect to the thickness direction TKD (the upper side in FIG. 5) is referred to as a "first side (with respect to the thickness direction TKD)" and the upstream side with respect to the thickness direction TKD (the lower side in FIG. 5) is referred to as a "second side (with respect to the thickness direction TKD)". A surface on the first side of a substrate or a plate is referred to as a front surface, and a surface on the second side of the substrate or the plate is referred to as a back surface.

FIG. 6 is a partial plan view of the head substrate 293 viewed from the thickness direction TKD. FIG. 6 illustrates a head-substrate back surface 293-*t* seen through the head substrate 293 from the downstream side (the upper side in FIG. 5) with respect to the thickness direction TKD. FIG. 7 is a stepped sectional view of the line head of the first embodiment taken along line VII,IX-VII,IX of FIG. 6, viewed from the longitudinal direction LGD (main scanning direction MD).

FIG. 6 also illustrates, with alternate long and short dash lines, first lenses LS1*a*, LS1*b*, and LS1*c* (represented by the numeral LS1 in FIG. 5), which are formed in the first lens array LA1, and second lenses LS2*a*, LS2*b*, and LS2*c* (represented by the numeral LS2 in FIG. 5), which are formed in the second lens array LA2, in order to illustrate the positional relationship between light emitting element groups EG, which are formed in the head substrate 293, the first lenses LS1*a*, LS1*b*, and LS1*c*, and the second lenses LS2*a*, LS2*b*, and LS2*c*. The reason for illustrating the first lenses LS1*a*, LS1*b*, and LS1*c* and the second lenses LS2*a*, LS2*b*, and LS2*c* in FIG. 6 is to indicate the positional relationship therebetween, and not to indicate that the first lenses LS1*a*, LS1*b*, and LS1*c* and the second lenses LS2*a*, LS2*b*, and LS2*c* are formed on the head-substrate back surface 293-*t* (FIG. 7).

The head substrate 293 is formed of a glass substrate that transmits light. A plurality of light emitting elements E, which are bottom emission organic EL (Electro-Luminescence) devices, are formed on the head-substrate back surface 293-*t* and sealed with a sealing member 294 (FIG. 7). The plurality of light emitting elements E have the same emission spectrum and emit light toward the surface of the photosensitive drum 21. As illustrated in FIG. 6, the plurality of light emitting elements E, which are arranged on the head-substrate back surface 293-*t*, are divided into groups. That is, one light emitting element group EG is constituted by fifteen light emitting elements E that are arranged in the longitudinal direction LGD in two lines in a staggered manner. Moreover, a plurality of light emitting element groups EG are arranged in the longitudinal direction LGD in three lines in a separately staggered manner.

In further detail, this arrangement can be described as follows. In each light emitting element group EG, fifteen light emitting elements E are disposed at different positions with respect to the longitudinal direction LGD. The distance between the light emitting elements E that are adjacent to each other in the longitudinal direction LGD is an inter-element pitch Pel (in other words, in each light emitting element group EG, fifteen light emitting elements E are arranged at the pitch Pel in the longitudinal direction LGD). The plurality of light emitting element groups EG are separately arranged in the longitudinal direction LGD at an inter-group pitch Peg, which is larger than the inter-element pitch Pel, thereby forming the light emitting element group line GRa. Three light emitting element group lines GRa, GRb, and GRc are separately disposed with a distance Dt therebetween in the lateral direction LTD. Moreover, the light emitting element group lines GRa, GRb, and GRc are shifted from each other by a distance Dg in the longitudinal direction LGD.

The inter-element pitch Pel can be obtained as the distance between the geometric barycenters of two light emitting elements E that are adjacent to each other in the longitudinal direction LGD. The inter-group pitch Peg can be obtained as the distance, in the longitudinal direction LGD, between the geometric barycenter of a light emitting element E that is at a front end of the light emitting element group EG with respect to the longitudinal direction LGD and the geometric barycenter of a light emitting element E that is at a back end of an adjacent light emitting element group EG with respect to the longitudinal direction LGD. The distance Dg can be obtained as the distance between the geometric barycenters of two light emitting element groups EG that are adjacent to each other in the longitudinal direction LGD. The distance Dt can be obtained as the distance between the geometric barycenters of two light emitting element groups EG that are adjacent to each other in the lateral direction LTD.

Thus, the plurality of light emitting element groups EG are separately arranged on the head-substrate back surface 293-*t*. On the other hand, a head-substrate front surface 293-*h* is attached to the second side of the head frame 291 with respect to the thickness direction TKD with an adhesive. The head-substrate front surface 293-*h* is in contact with the light blocking member 297 disposed in the head frame 291. A second side of the light blocking member 297 with respect to the thickness direction TKD is attached to the head-substrate front surface 293-*h* with an adhesive. Light guide holes 2971 extend through the light blocking member 297 in the thickness direction TKD. The light guide holes 2971 are circular in plan view when viewed from the thickness direction TKD, and the inner walls thereof are black plated. Each of the light guide holes 2971 corresponds to one of the light emitting element groups EG. That is, one light guide hole 2971 is formed for one light emitting element group EG. Thus, the light blocking member 297 is attached to the head-substrate front surface 293-*h* in such a manner that the light guide hole 2971 is open toward the light emitting element group EG.

The light blocking member 297 is provided in order to prevent so-called stray light from entering the lenses LS1 and LS2. Each of the light emitting element groups EG includes a dedicated optical system constituted by a pair of the lenses LS1 and LS2. When using such a structure, it is desirable that a light enter only the optical system constituted by LS1 and LS2 of the light emitting element group EG that is an emission source thereof and be focused. However, a part of the light may not enter the optical system constituted by LS1 and LS2 of the light emitting element group EG that is the emission source thereof. This part of the light becomes stray light. If such stray light enters the optical system constituted by LS1 and LS2 of the light emitting element group EG that is not the emission source thereof, a so-called ghost may be generated. In order to prevent this, in the embodiment, the light blocking member 297 is disposed between the light emitting element group EG and the optical system constituted by LS1 and LS2. The light blocking member 297 has the light guide hole 2971 that has a black-plated inner wall and that is open toward the light emitting element group EG. Therefore, most of the stray light is absorbed by the inner wall of the light guide hole 2971. As a result, ghost is suppressed and a good exposure operation can be realized.

On a first side of the light blocking member 297 with respect to the thickness direction TKD, a first lens array LA1, which is substantially flat-plate shaped, is supported between side portions 291A and 291B of the head frame 291 in the lateral direction LTD. On the back surface of the first lens array LA1, the first lenses LS1 (LS1*a*, LS1*b*, and LS1*c*) are formed so as to correspond to the light emitting element groups EG. That is, one first lens LS1 faces one light emitting element group EG. Thus, in the first lens array LA1, a plurality of first lenses LS1 are arranged in three lines in a staggered manner. In other words, three first lenses LS1 (LS1*a*, LS1*b*, and LS1*c*) that are disposed adjacent to each other in the main scanning direction MD (longitudinal direction LGD) are disposed at different positions with respect to the sub-scanning direction SD (lateral direction LTD). In FIGS. 6 and 7, the first lenses LS1 are illustrated differently in accordance with their positions in the sub-scanning direction SD. That is, the first lens LS1 that is located at the most upstream position with respect to the sub-scanning direction SD is represented by the numeral LS1*a*, the first lens LS1 that is located in the middle position with respect to the sub-scanning direction SD is represented by the numeral LS1*b*, and the first lens LS1 that is located at the most downstream position with respect to the sub-scanning direction SD is represented by the numeral LS1*c*.

On a first side of the first lens array LA1 with respect to the thickness direction TKD, a second lens array LA2, which is substantially flat-plate shaped, is supported between the side portions 291A and 291B in the lateral direction LTD of the head frame 291. On the back surface of the second lens array LA2, the second lenses LS2 (LS2*a*, LS2*b*, and LS2*c*) are formed so as to correspond to the light emitting element groups EG. That is, one second lens LS2 faces one light emitting element group EG. Thus, in the second lens array LA2, a plurality of second lenses LS2 are arranged in three lines in a staggered manner. In other words, the second lenses LS2 (LS2*a*, LS2*b*, and LS2*c*) that are disposed adjacent to each other in the main scanning direction MD (longitudinal direction LGD) are disposed at different positions with respect to the sub-scanning direction SD (lateral direction LTD). In FIGS. 6 and 7, the second lenses LS2 are illustrated differently in accordance with their positions with respect to the sub-scanning direction SD. That is, the second lens LS2 that is located at the most upstream position with respect to the sub-scanning direction SD is represented by the numeral LS2*a*, the second lens LS2 that is located in the middle position with respect to the sub-scanning direction SD is represented by the numeral LS2*b*, and the second lens LS1 that is located at the most downstream position with respect to the sub-scanning direction SD is represented by the numeral LS2*c*.

Each of the lens arrays LA1 and LA2 includes a light-transmissive lens array substrate SB made of glass. The lenses LS1 and LS2, which are made of resin, are formed on a back surface SB-t of the lens array substrate SB. That is, the first lenses LS1 (LS1*a*, LS1*b*, and LS1*c*), which are made of resin, are formed on the back surface of the substrate SB of the first lens array LA1 (in the same plane). The second lenses LS2 (LS2*a*, LS2*b*, and LS2*c*), which are made of resin, are formed on the back surface of the substrate SB of the second lens array LA2. The lens arrays LA1 and LA2 can be formed by using an existing method, such as a method of using a metal mold. With this method, a metal mold having concave portions corresponding to the shapes of the lenses LS1 and LS2 is made to contact the back surface SB-t of the lens array substrate SB, and a photo-curable resin is injected into a space between the metal mold and the lens array substrate SB. Subsequently, the photo-curable resin is irradiated with light so that the resin is cured, thereby forming the lenses LS1 and LS2 on the lens array substrate SB.

Thus, three optical systems, that is, the upstream optical system constituted by LS1*a* and LS2*a*, the middle optical system constituted by LS1*b* and LS2*b*, and the downstream optical system constituted by LS1*c* and LS2*c* are disposed at different positions with respect to the sub-scanning direction SD. The optical axes OAa, OAb, and OAc of the three optical systems (such as that constituted by LS1*a* and LS2*a*) are parallel to each other, and parallel to the optical axis direction Doa illustrated in FIG. 7 and other figures. The optical axis direction Doa is parallel to the optical axes OAa, OAb, and OAc, parallel to the direction in which the light emitting elements E emit light, and parallel to the thickness direction TKD. The distance between the upstream optical system constituted by LS1*a* and LS2*a* and the middle optical system constituted by LS1*b* and LS2*b* and the distance between the middle optical system constituted by LS1*b* and LS2*b* and the downstream optical system constituted by LS1*c* and LS2*c* in the sub-scanning direction SD are the same distance L1*s*. The distances between the optical systems (such as that constituted by LS1*a* and LS2*a*) can be obtained as the distances between the optical axes OAa, OAb, and OAc.

Each of the upstream optical system constituted by LS1*a* and LS2*a*, the middle optical system constituted by LS1*b* and LS2*b*, and the downstream optical system constituted by LS1*c* and LS2*c* converges a light emitted from the light emitting element E on the peripheral surface of the photosensitive drum 21. These optical systems converge light at the vicinities of intersection points 1*a*, 1*b*, and 1*c* of the peripheral surface of the photosensitive drum 21 and the optical axes OAa, OAb, and OAc, respectively (FIG. 7), thereby forming converged light (spots SP) at different positions with respect to the sub-scanning direction SD. Each of the optical systems in the embodiment forms an inverted reduced image. The magnification is a negative value whose absolute value is smaller than 1.

The peripheral surface of the photosensitive drum 21 has a finite curvature. The optical axis OAb of the middle optical system passes through the center of curvature CT21 of the photosensitive drum 21. The optical axis OAa of the upstream optical system constituted by LS1*a* and LS2*a* and the optical axis OAc of the downstream optical system constituted by LSlc and LS2*c* are located on lateral sides of the optical axis OAb of the middle optical system at a distance L1*s* in the sub-scanning direction SD. As a result, an intersection point Ib, at which the optical axis OAb of the middle optical system intersects the peripheral surface of the photosensitive drum 21, is displaced from the intersection point Ia, at which the optical axis OAa of the upstream optical system intersects the peripheral surface of the photosensitive drum 21, and from the intersection point Ic, at which the optical axis OAc of the downstream optical system intersects the peripheral surface of the photosensitive drum 21, by a distance d in the optical axis direction Doa.

That is, the upstream optical system constituted by LS1*a* and LS2*a* forms the spot SP in the vicinity of the intersection point Ia and the middle optical system constituted by LS1*b* and LS2*b* forms the spot SP in the vicinity of the intersection point Ib, the intersection points Ia and Ib being displaced from each other by the distance d in the optical axis direction. The same relationship exists between the downstream optical system constituted by LS1*c* and LS2*c* and the middle optical system constituted by LS1*b* and LS2*b*. Owing to the displacement by the distance d, the size of the spot SP formed by the upstream optical system constituted by LS1*a* and LS2*a* and the size of the spot SP formed by the middle optical system constituted by LS1*b* and LS2*b* may become different from each other, and the size of the spot formed by the downstream optical system constituted by LS1*a* and LS2*a* and the size of the spot SP formed by the middle optical system constituted by LS1*b* and LS2*b* may become different from each other.

In order to prevent this, in the embodiment, the apparent depths of focus of the optical systems are increased. That is, in the embodiment, the light emitting elements E have an emission spectrum having peaks at wavelengths λ1 and λ2. Each of the upstream optical system constituted by LS1*a* and LS2*a*, the middle optical system constituted by LS1*b* and LS2*b*, and the downstream optical system constituted by LS1*c* and LS2*c* focuses a light having the wavelength λ1 and a light having the wavelength λ2 at different positions with respect to the optical axis direction Doa. As the light emitting element E, for example, an organic EL device described in JP-A-10-237439 can be used. To be specific, the organic EL device has an emission spectrum having peaks at wavelengths of 463 nm and 534 nm.

Figure 8:
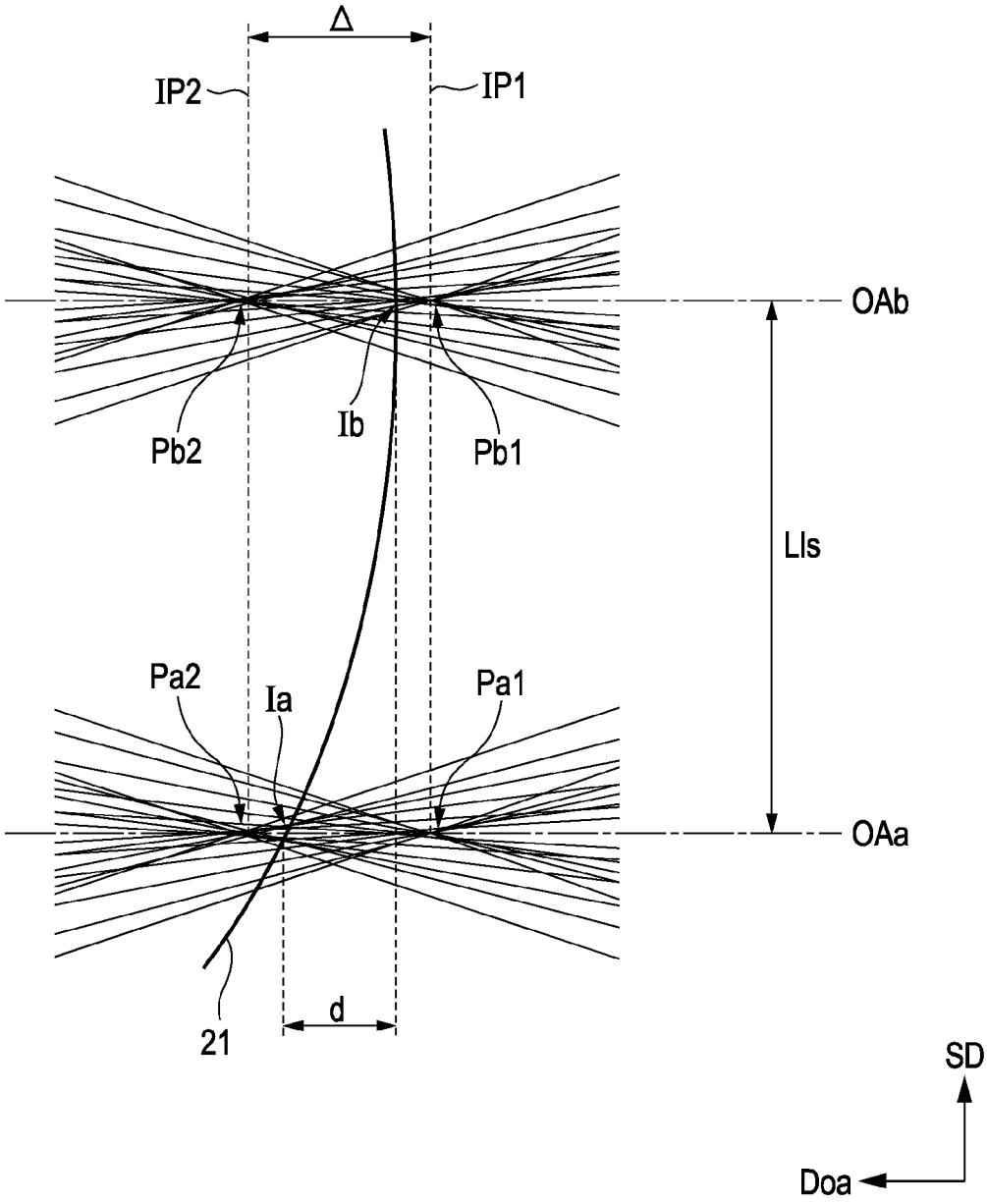
FIG. 8 is a diagram used to describe an imaging operation performed by an optical system in the invention.

FIG. 8 is a diagram used to describe an imaging operation performed by the optical system in the invention, viewed from the main scanning direction MD. In FIG. 8, illustration of an imaging operation performed by the downstream optical system is omitted, because the imaging operation performed by the downstream optical system is the same as the imaging operation performed by the upstream optical system. In FIG. 8, the optical system is not illustrated except for the optical axis in order to magnify the vicinity of the imaging position.

As illustrated in FIG. 8, the upstream optical system constituted by LS1*a* and LS2*a* focuses a light having the wavelength λ1 at the imaging position Pa1 and focuses a light having the wavelength λ2 at the imaging position Pa2 that is separated from the imaging position Pa1 by a distance Δ in the optical axis direction. Thus, an effect is obtained in that the apparent depth of focus of the upstream optical system constituted by LS1*a* and LS2*a* is increased. The middle optical system constituted by LS1*b* and LS2*b* focuses a light having the wavelength λ1 at the imaging position Pb1 and focuses a light having the wavelength λ2 at the imaging position Pb2 that is separated from the imaging position Pb1 by a distance Δ in the optical axis direction. Thus, an effect is obtained in that the apparent depth of focus of the middle optical system constituted by LS1*b* and LS2*b* is increased.

The upstream optical system constituted by LS1*a* and LS2*a* and the middle optical system constituted by LS1*b* and LS2*b* have the same optical structure. Therefore, the imaging positions Pa1 and Pb1 are the same in the optical axis direction Doa, and the imaging position Pa2 and Pb2 are the same in the optical axis direction Doa. Therefore, the imaging positions Pa1 and Pb1 are in a first imaging plane IP1 that is perpendicular to the optical axis direction Doa, and the imaging positions Pa2 and Pb2 are in a second imaging plane IP2 that is perpendicular to the optical axis direction Doa. The distance between the first imaging plane IP1 and the second imaging plane IP2 is the distance Δ. The distance Δ is equal to or larger than the distance d, which is the distance between the intersection point Ia and the intersection point Ib in the optical axis direction Doa. Both the intersection points Ia and Ib are located between the first imaging plane IP1 and the second imaging plane IP2.

Thus, in the first embodiment, the light emitting element E emits a light having the wavelength λ1 and a light having the wavelength λ2. The optical system constituted by LS1*a* and LS2*a*, for example, focuses the light having the wavelengths λ1 and the light having the wavelength λ2 at imaging positions Pa1 and Pa2 that are separated from each other by the distance Δ in the optical axis direction Doa. Thus, an effect is obtained in that the apparent depth of focus of the optical system constituted by LS1*a* and LS2*a* is increased. The distance Δ is equal to or larger than the distance d. Therefore, for the same reason that is described in the section "A. Cause of Difference between the Sizes of Converged Light and Measures to deal therewith", the difference between the sizes of the spots SP formed by the optical systems are suppressed, whereby a good exposure can be realized.

Moreover, in the first embodiment, the apparent depths of focus of the upstream optical system constituted by LS1*a* and LS2*a* and the middle optical system constituted by LS1*b* and LS2*b* are sufficiently increased relative to the displacement between the spots SP formed by the optical systems in the optical axis direction Doa. Thus, the difference between the sizes of the spots SP formed by the optical systems can be more reliably suppressed, whereby a better exposure can be realized. The same relationship and advantage apply to the downstream optical system constituted by LS1*c* and LS2*c* and the middle optical system constituted by LS1*b* and LS2*b* having the structure same as that described above.

In the first embodiment, the light emitting element E has an emission spectrum having peaks at the wavelengths λ1 and λ2. Thus, the apparent depth of focus is effectively increased, whereby a better exposure can be realized.

B-2. Second Embodiment

In the first embodiment, the imaging position of the light having the wavelength λ1 and the imaging position of the light having the wavelength λ2 are separated from each other by the distance Δ in the optical axis direction Doa. In other words, the distance Δ between the first imaging plane IP1 and the second imaging plane IP2 in the optical axis direction Doa is equal to or larger than the distance d, so that the difference between the sizes of the spots SP formed by the optical systems is suppressed. However, if the distance Δ is too large, aberration of the spot SP becomes large and an imaging performance deteriorates, so that exposure may become uneven and the resolution may decrease. Therefore, a second embodiment has the following structure, in addition to the structure the same as that of the first embodiment. Needless to say, the second embodiment has the same advantage as that of the first embodiment, because the second embodiment include the structure the same as that of the first embodiment.

Figure 9:
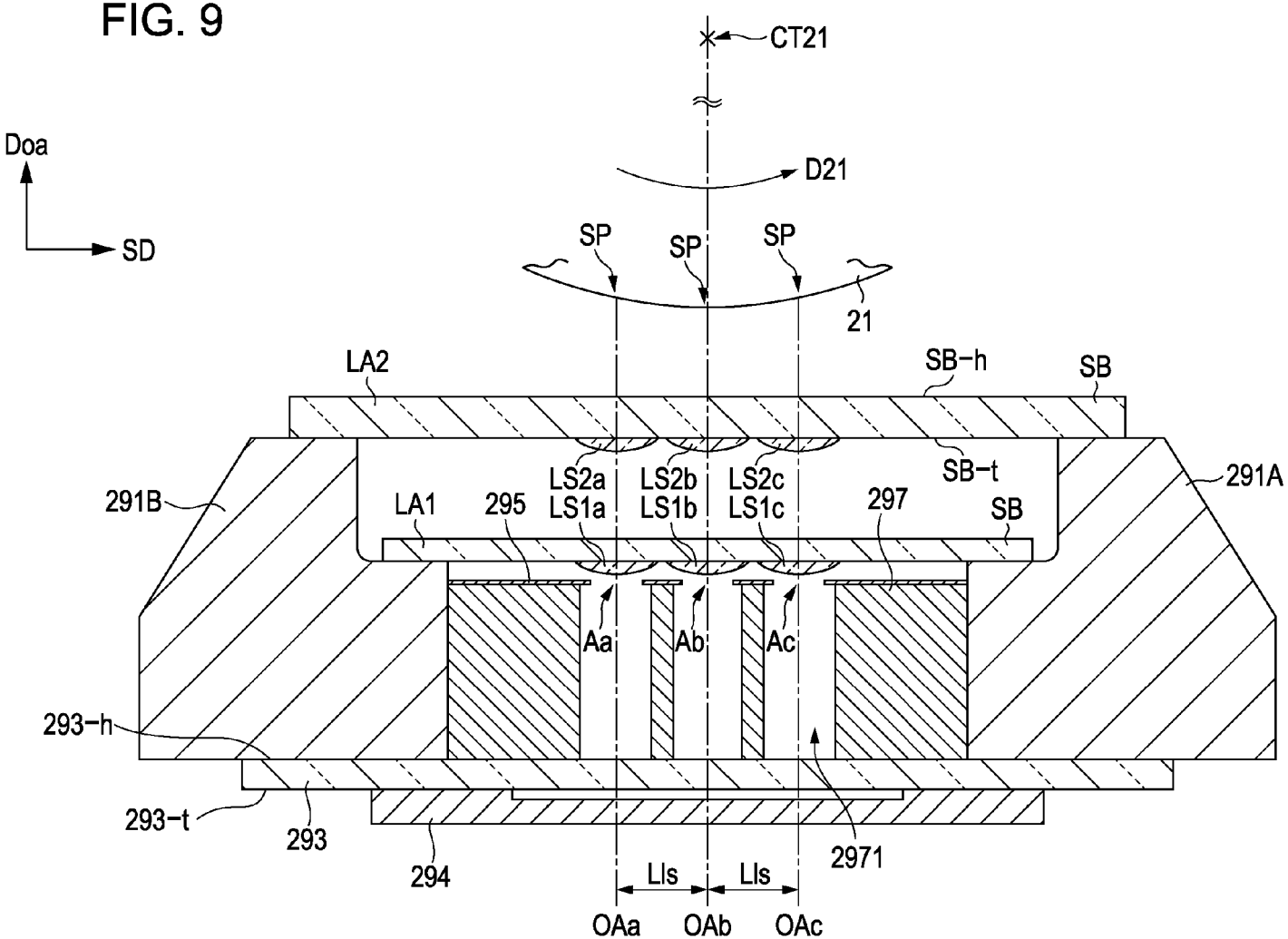
FIG. 9 is a stepped sectional view of a line head of a second embodiment taken along line VII,IX-VII,IX of FIG. 6.

FIG. 9 is a stepped sectional view of a line head of the second embodiment taken along line VII,IX-VII,IX of FIG. 6, when the cross section is viewed from the longitudinal direction LGD (main scanning direction MD). As illustrated in FIG. 9, the line head of the second embodiment includes a diaphragm plate 295 that is disposed between the first lens array LA1 and the light blocking member 297. Aperture diaphragms Aa, Ab, and Ac, which correspond to the optical systems, are formed in the diaphragm plate 295. The aperture diaphragm Δα limits the amount of light that enters, for example, the optical system constituted by LS1*a* and LS2*a*. The second embodiment has the following optical structure including the aperture diaphragms Aa, Ab, and Ac.

Figure 10:
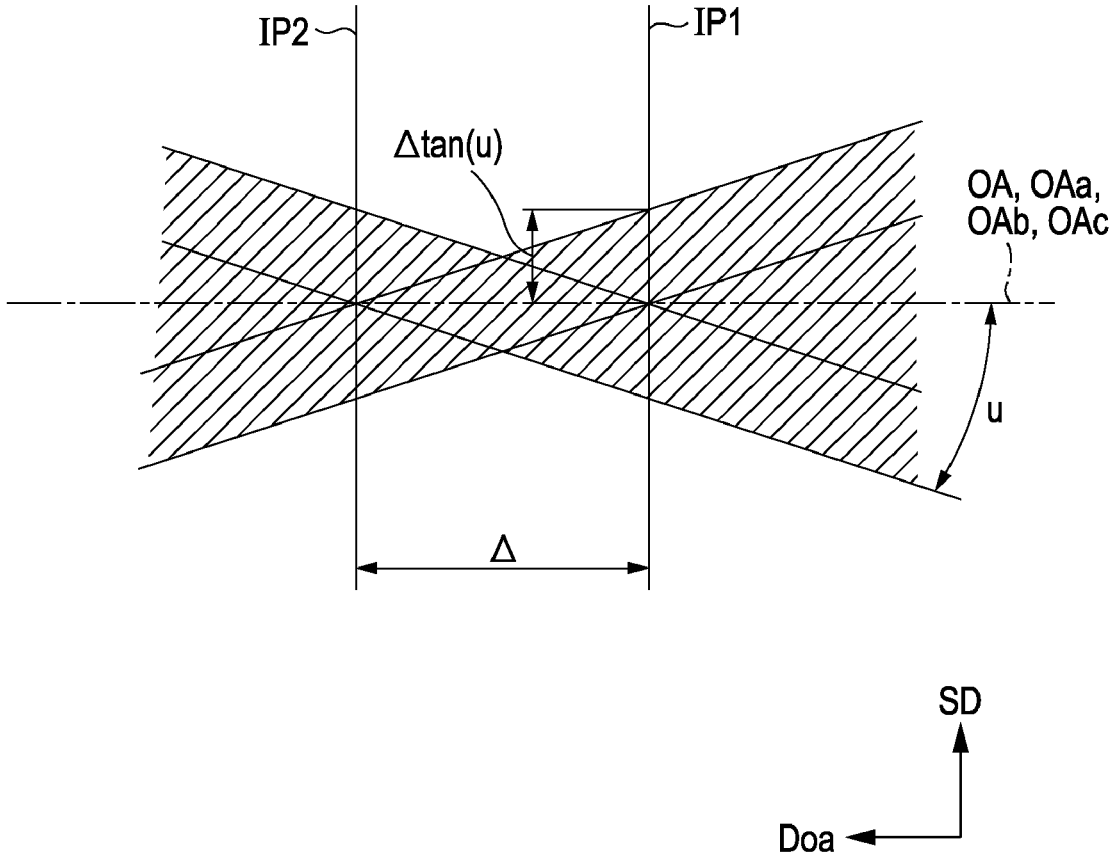
FIG. 10 is a diagram for describing the optical structure of the second embodiment.

FIG. 10 is a diagram for describing the optical structure of the second embodiment. If the influence of aberration of the light having the wavelength λ2 (second wavelength) in the imaging plane IP1 of the light having the wavelength λ1 (first wavelength) becomes comparable to the size of an image of a light emitting element on an image surface, the resolution conspicuously decreases. In order to form a fine image, it is desirable that such decrease in the resolution be suppressed. In the second embodiment, an expression $$\Delta \leqq |m| \times D/\tan(u) \qquad \text{(expression 2)}$$

is satisfied, where D is a diameter of the light emitting element E with respect to the main scanning direction MD, m is a lateral magnification of the optical system with respect to the main scanning direction MD, and u is an image-side angular aperture that is half the angle between two lines connecting an image point and ends of a diameter of an entrance pupil. Thus, an influence on the imaging performance such as aberration is suppressed, so that a better exposure can be realized.

B-3. Third Embodiment

Figure 11:
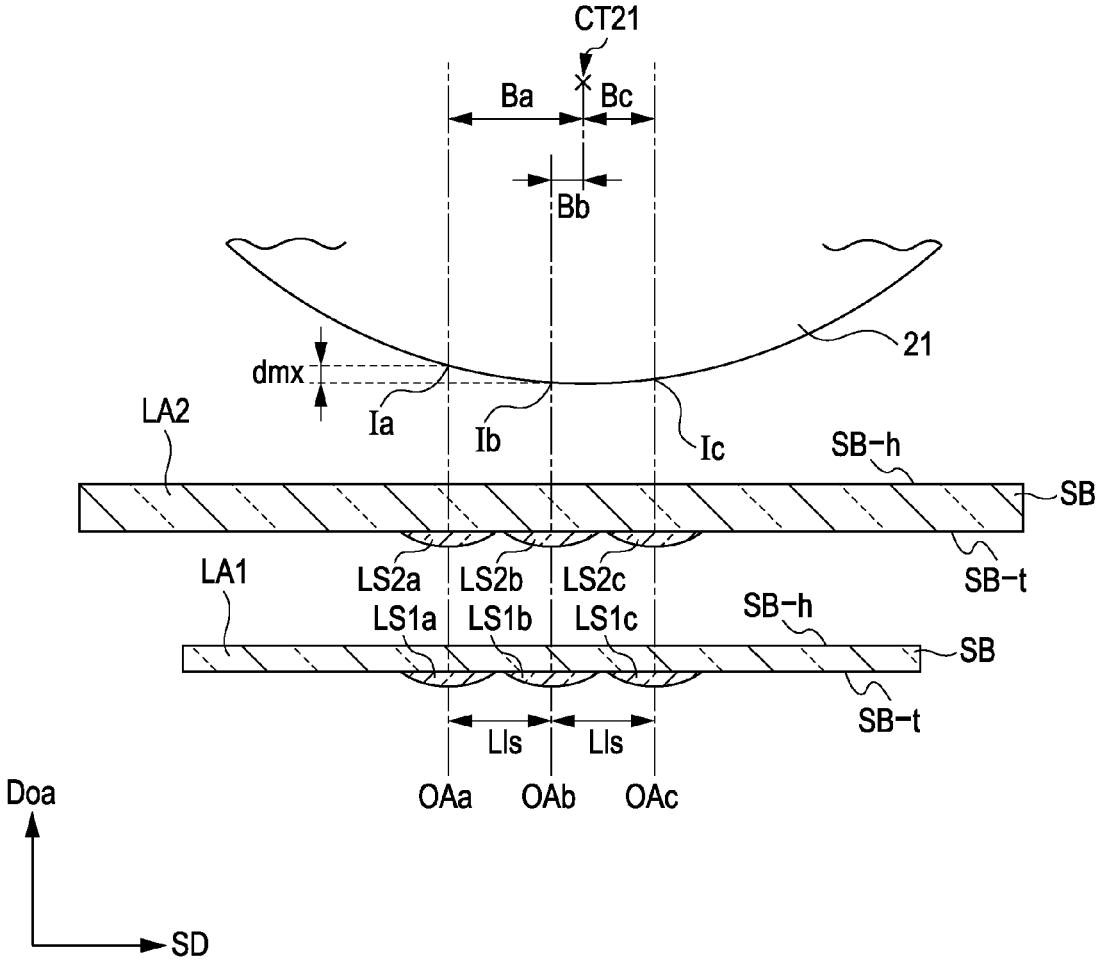
FIG. 11 is a diagram illustrating the structure of a line head of a third embodiment.

FIG. 11 is a diagram illustrating the structure of a line head of a third embodiment, viewed from the main scanning direction MD. The third embodiment differs from the first embodiment mainly in that the optical axis OAb of the middle optical system constituted by LS1*b* and LS2*b* is off the center of curvature CT21 of the photosensitive drum 21. As a result, a relationship Ba>Bc>Bb (Ba is the largest and Bb is the smallest) is satisfied, where Ba is the distance between the center of curvature CT21 and the optical axis OAa of the upstream optical system, Bb is the distance between the center of curvature CT21 and the optical axis OAb of the middle optical system, and Bc is the distance between the center of curvature CT21 and the optical axis OAc of the downstream optical system.

With this structure, there is a large displacement dmx between the intersection points Ia and Ib in the optical axis direction Doa, where the intersection point Ia is a point at which the peripheral surface of the photosensitive drum 21 intersects the optical axis OAa, which is farthest from the center of curvature CT21, and the intersection point Ib is a point at which the peripheral surface of the photosensitive drum 21 intersects the optical axis OAb, which is nearest to the center of curvature CT21. Owing to the large displacement dmx, between the upstream optical system constituted by LS1*a* and LS2*a* and the middle optical system constituted by LS1*b* and LS2*b*, the difference between the positions at which the spots SP are formed differ greatly in the optical axis direction Doa. Therefore, the difference between the sizes of the spots SP is significant between the upstream optical system constituted by LS1*a* and LS2*a* and the middle optical system constituted by LS2*b*.

Thus, it is preferable that the apparent depth of focus be increased for at least one of the upstream optical system constituted by LS1*a* and LS2*a* and the middle optical system constituted by LS1*b* and LS2*b*. That is, by making the distance Δ, which is the distance between the imaging position of the light having the wavelength λ1 and the imaging position of the light having the wavelength λ2 in the optical axis direction Doa, equal to or larger than the distance dmx, the difference between the sizes of the spots formed by the upstream optical system constituted by LS1*a* and LS2*a* and the middle optical system constituted by LS1*b* and LS2*b* can be suppressed, whereby a good exposure can be realized.

Moreover, the third embodiment has the following operational advantage. As described above, if the distance Δ between the imaging position of the light having the wavelength λ1 and the imaging position of the light having the wavelength λ2 is too large, there may be an influence on the imaging performance such as aberration. The influence on the imaging performance such as aberration may be suppressed by decreasing the distance Δ. For this purpose, it is preferable that the distance d be decreased, because, in this case, the distance Δ can be decreased while satisfying the condition that the distance Δ is equal to or larger than the distance dmx. In the line head 29 of the third embodiment, (2N+1) optical systems (where N is an integer equal to or greater than 1, and N=1 in the third embodiment) are arranged in the sub-scanning direction SD at a distance L1*s* therebetween, and the optical system constituted by LS1*b* and LS2*b* that are nearest to the center of curvature CT21 are located at the (N+1)th position from and end of the (2N+1) optical systems. In this case, because the distance d is decreased, the distance Δ can be decreased while satisfying the condition that the distance Δ is equal to or larger than the distance dmx, whereby an influence on the imaging performance such as aberration can be easily suppressed.

B-4. Fourth Embodiment

Figure 12:
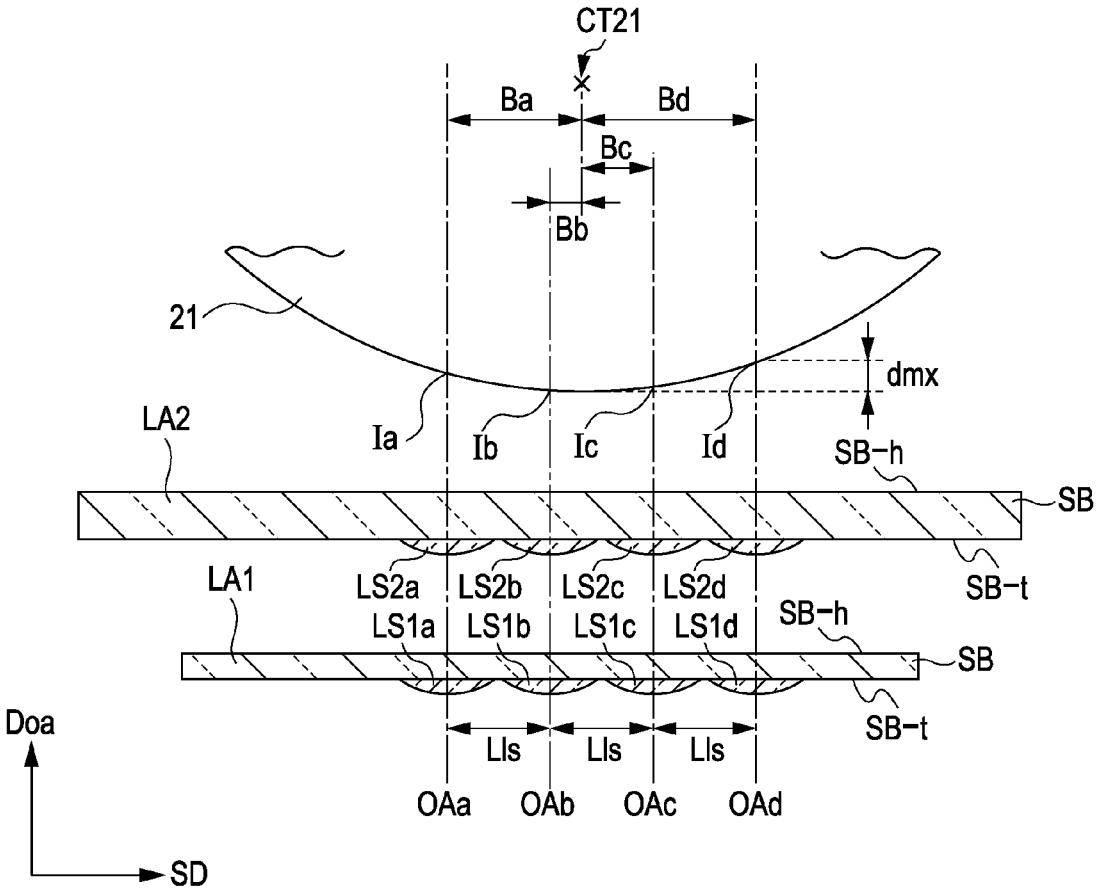
FIG. 12 is a diagram illustrating the structure of a line head of a fourth embodiment.

FIG. 12 is a diagram illustrating the structure of a line head of a fourth embodiment, viewed from the main scanning direction MD. The fourth embodiment differs from the first embodiment mainly in that lenses of the lens arrays LA1 and LA2 are arranged in four lines in a staggered manner. With this arrangement, as illustrated in FIG. 12, four optical systems (that is, the optical system constituted by LS1*a* and LS2*a*, the optical system constituted by LS1*b* and LS2*b*, the optical system constituted by LS1*c* and LS2*c*, and an optical system constituted by LS1*d* and LS2*d*) are arranged in the sub-scanning direction SD at a distance L1*s*.

As illustrated in FIG. 12, in the fourth embodiment, a relationship Bd>Ba>Bc>Bb (the distance Bd is the largest and the distance Bb is the smallest) is satisfied, where Ba it the distance between the center of curvature CT21 and the optical axis OAa of the optical system constituted by LS1*a* and LS2*a*, Bb is the distance between the center of curvature CT21 and the optical axis OAb of the optical system constituted by LS1*b* and LS2*b*, Bc is the distance between the center of curvature CT21 and the optical axis OAc of the optical system constituted by LS1*c* and LS2*c*, and Bd is the distance between the center of curvature CT21 and the optical axis OAd of the optical system constituted by LS1*d* and LS2*d*.

With this structure, there is a large displacement dmx between the intersection points Id and Ib in the optical axis direction Doa, where the intersection point Id is a point at which the peripheral surface of the photosensitive drum 21 intersects the optical axis OAd, which is farthest from the center of curvature CT21, and the intersection point Ib is a point at which the peripheral surface of the photosensitive drum 21 intersects the optical axis OAb, which is nearest to the center of curvature CT21. Owing to the large displacement dmx, between the optical system constituted by LS1*d* and LS2*d* and the optical system constituted by LS1*b* and LS2*b*, the difference between the positions at which the spots SP are formed differ greatly in the optical axis direction Doa. Therefore, the difference between the sizes of the spots SP is significant between the optical system constituted by LS1*d* and LS2*d* and the optical system constituted by LS1*b* and LS2*b*.

Thus, it is preferable that the apparent depth of focus be increased for at least one of the optical system constituted by LS1*d* and LS2*d* and the optical system constituted by LS1*b* and LS2*b*. That is, by making the distance Δ, which is the distance between the imaging position of the light having the wavelength λ1 and the imaging position of the light having the wavelength λ2 in the optical axis direction Doa, equal to or larger than the distance dmx, the difference between the sizes of the spots formed by the optical system constituted by LS1*d* and LS2*d* and the middle optical system constituted by LS1*b* and LS2*b* can be suppressed, whereby a good exposure can be realized.

Moreover, the fourth embodiment has the following operational advantage. As described above, if the distance Δ between the imaging position of the light having the wavelength λ1 and the imaging position of the light having the wavelength λ2 is too large, there may be an influence on the imaging performance such as aberration. The influence on the imaging performance such as aberration may be suppressed by decreasing the distance Δ. For this purpose, it is preferable that the distance d be decreased, because, in this case, the distance Δ can be decreased while satisfying the condition that the distance Δ is equal to or larger than the distance dmx. In the line head 29 of the fourth embodiment, (2N+2) optical systems (where N is an integer equal to or greater than 1, and N=1 in the fourth embodiment) are arranged in the sub-scanning direction with a distance L1*s* therebetween, and the optical system constituted by LS1*b* and LS2*b* that is nearest to the center of curvature CT21 are located at the (N+1)th or the (N+2)th position from and end of the (2N+2) optical systems. In this case, because the distance d is decreased, the distance Δ can be decreased while satisfying the condition that the distance Δ is equal to or larger than the distance dmx, whereby an influence on the imaging performance such as aberration can be easily suppressed.

Modifications

In the embodiments, the line head 29 corresponds to the "exposure head" of the invention, the photosensitive drum 21 corresponds to the "image carrier" of the invention, the sub-scanning direction SD corresponds to the "first direction" of the invention, the main scanning direction corresponds to the "second direction" of the invention, and the peripheral surface of the photosensitive drum 21 corresponds to the "exposure surface" of the invention. In the description of FIG. 1 in the section "A. Cause of Difference between the Sizes of Converged Light and Measures to deal therewith", the optical system OSα corresponds to the "first optical system" of the invention, the optical system OSβ corresponds to "second optical system" of the invention, and the imaging position Pα1 corresponds to the "imaging position P11" of the invention, and the imaging position Pα2 corresponds to the "imaging position P12" of the invention. In the description of FIG. 2 in the section "A. Cause of Difference between the Sizes of Converged Light and Measures to deal therewith", the optical system OSβ corresponds to the "first optical system" of the invention, the optical system OSα corresponds to the "second optical system" of the invention, the imaging position Pβ1 corresponds to the "imaging position P11" of the invention, and imaging position Pβ2 corresponds to the "imaging position P12" of the invention. In the first embodiment, if the upstream optical system constituted by LSa1 and LSa2 corresponds to the "first optical system", the middle optical system constituted by LSb1 and LSb2 corresponds to the "second optical system", the imaging position Pa1 corresponds to the "imaging position P11" of the invention, the imaging position Pa2 corresponds to the "imaging position P12" of the invention, and the imaging position Pb1 corresponds to the "imaging position P21" of the invention, and the imaging position Pb2 corresponds to the "imaging position Pb2" of the invention.

Figure 13:
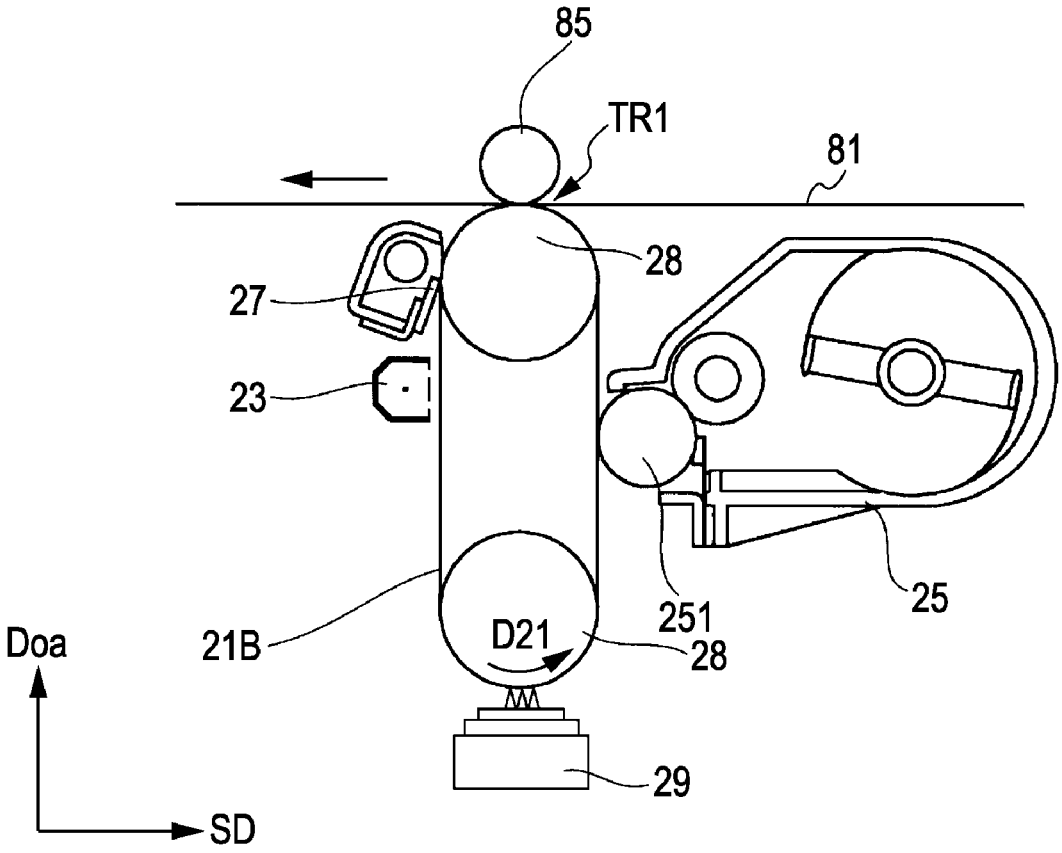
FIG. 13 is a diagram illustrating a modification of an image forming apparatus according to an aspect of the invention.

The invention is not limited to the embodiments described above, and the embodiments can be modified in various ways within the spirit and scope of the invention. FIG. 13 is a diagram illustrating a modification of an image forming apparatus according to the invention. This modification differs from the first embodiment in the shape of a photosensitive body. That is, in this modification, a photosensitive belt 21B is used instead of the photosensitive drum 21. Because other members are the same as the embodiment described above, such members are denoted by the same or similar numerals and the description thereof is omitted.

In this modification, the photosensitive belt 21B is looped over two rollers 28 that extend in the main scanning direction MD. The photosensitive belt 21B is rotated in a predetermined rotation direction D21 by a drive motor (not shown). The charger 23, the line head 29, the developing section 25, and the photosensitive-body cleaner 27 are disposed around the photosensitive belt 21B in the rotation direction D21. These members perform charging, forming of a latent image, and developing of toner.

In this modification, the line head 29 is disposed so as to face a looped-over portion of the photosensitive belt 21B at which the photosensitive belt 21B is looped over one of the rollers 28. The rollers 28 are cylindrical. Therefore, the looped-over portion of the photosensitive belt 21B has a finite curvature. The line head 29 is disposed so as to face the looped-over portion for the following reason. That is, an extended portion of the photosensitive belt 21B flutters to a greater degree than the looped-over portion. By disposing the line head 29 so as to face the looped-over portion that flatters to a smaller degree than the extended portion, the distance between the line head 29 and the surface of the photosensitive belt 21B can be stabilized.

However, because the surface of the photosensitive at the looped-over portion has a finite curvature in the sub-scanning direction SD, defective exposure may occur as described above. Therefore, by applying the invention to an image forming apparatus having the structure illustrated in FIG. 13, a good exposure can be realized.

Figure 14:
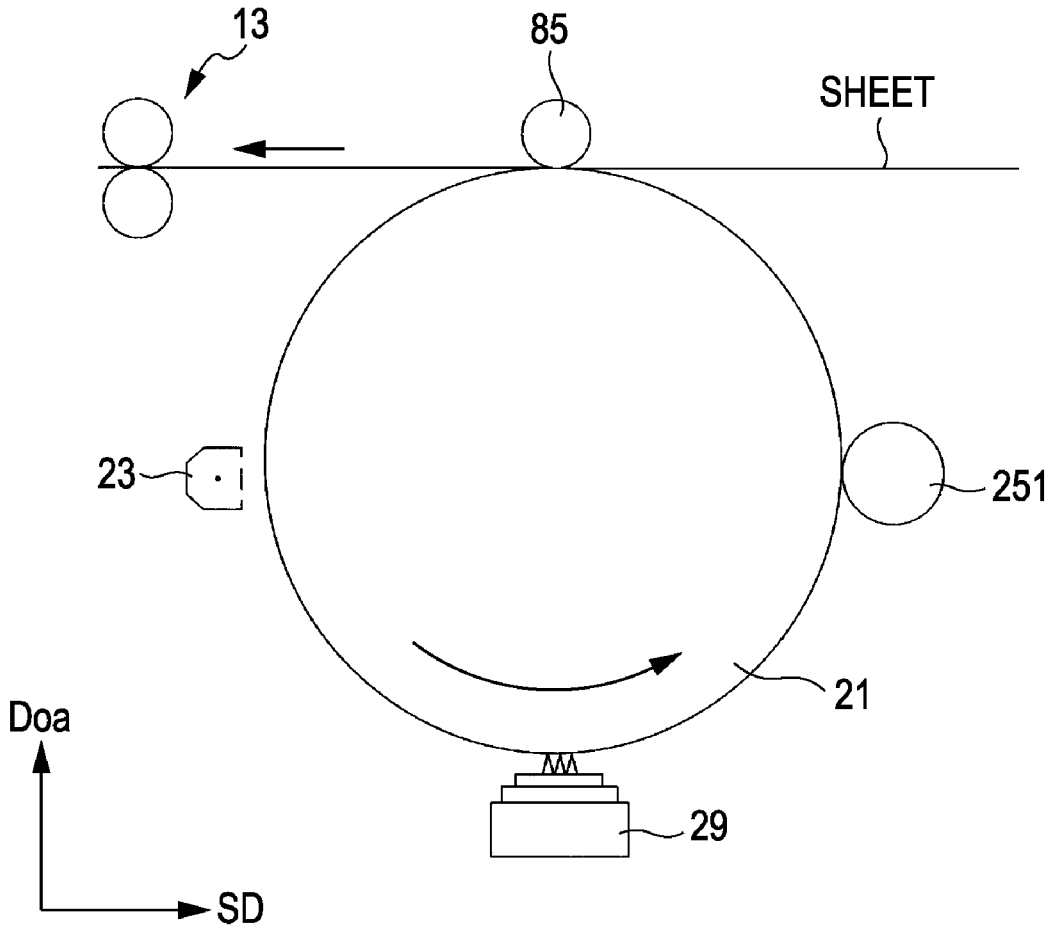
FIG. 14 is a diagram illustrating another modification of an image forming apparatus according to an aspect of the invention.

FIG. 14 is a diagram illustrating another modification of an image forming apparatus according to the invention. This modification differs from the first embodiment in that the transfer belt 81 is not used. That is, in this modification, a toner image formed on the photosensitive drum 21 is directly transferred from the transfer roller 85 onto a sheet, and then the toner image is fixed by the fixing unit 13. Moreover, in this modification, the photosensitive drum 21, which is to be exposed with the line head 29, has a finite curvature in the sub-scanning direction SD. Hence, a defective exposure described above may occur. Therefore, by applying the invention to an image forming apparatus having the structure illustrated in FIG. 14, a good exposure can be realized.

In the embodiments, the peak strengths of the light emitting element at the wavelengths λ1 and λ2 are not specified. However, the peak strengths at the wavelengths λ1 and λ2 may be greater than half the maximum value of the emission spectrum. In this case, the depth of focus can be more effectively increased.

In the embodiments, the optical system forms an inverted reduced image with a negative magnification having an absolute value smaller than 1. However, the magnification of the optical system is not limited thereto. The magnification may be positive and may have an absolute value equal to or larger than 1.

In the embodiments, the lenses are arranged in the lens arrays LA1 and LA2 in three or four lines in a staggered manner. However, the arrangement of the lenses is not limited thereto.

In the third and fourth embodiments, the integer N is 1. However, the integer N is not limited to 1, and may be equal to or larger than 2.

In the embodiments, the optical systems are arranged at a distance L1*s* in the sub-scanning direction SD. However, the optical systems may not be arranged at a regular distance.

In the embodiments, the lenses LS1 and LS2 are formed on the back surfaces of the lens arrays LA1 and LA2. However, the lenses LS1 and LS2 may be formed, for example, on the front surfaces of the lens arrays LA1 and LA2.

In the embodiments, the lens arrays LA1 and LA2 include the light transmissive substrates SB1 and SB2, which are made of glass, and the lenses LSa1, LSa2, and the like, which are made of resin. However, the lens arrays LA1 and LA2 may be integrally formed.

In the first embodiment, the plurality of light emitting element groups EG are arranged in three lines in a staggered manner. However, the arrangement of the plurality of light emitting element groups EG is not limited thereto.

In the embodiments, fifteen light emitting element E constitutes the light emitting element group EG. However, the number of the light emitting elements E that constitute the light emitting element group EG is not limited thereto.

In the embodiments, the plurality of light emitting elements E included the light emitting element group EG are arranged in two lines in a staggered manner. However, the arrangement of the plurality of light emitting elements E in the light emitting element group EG is not limited thereto.

In the embodiments, bottom emission organic EL devices are used as the light emitting elements E. However, top emission organic EL devices may be used as the light emitting elements E. Alternatively, light emitting diodes (LEDs) other than the organic EL devices may be used as the light emitting elements E.

In the embodiments, the light emitting element E has an emission spectrum with peaks at the wavelengths λ1 and λ2. However, it is not necessary that the light emitting element E have peaks at the wavelengths λ1 and λ2. As long as the light emitting element E can emit light having the wavelength λ1 and light having the wavelength λ2, the depth of focus can be increased.

Example

An example of the invention will be described below. However, the invention is not limited to the example, and can be modified within the spirit an scope of the invention, and such modification are included in the technical scope of the invention.

Figure 18:
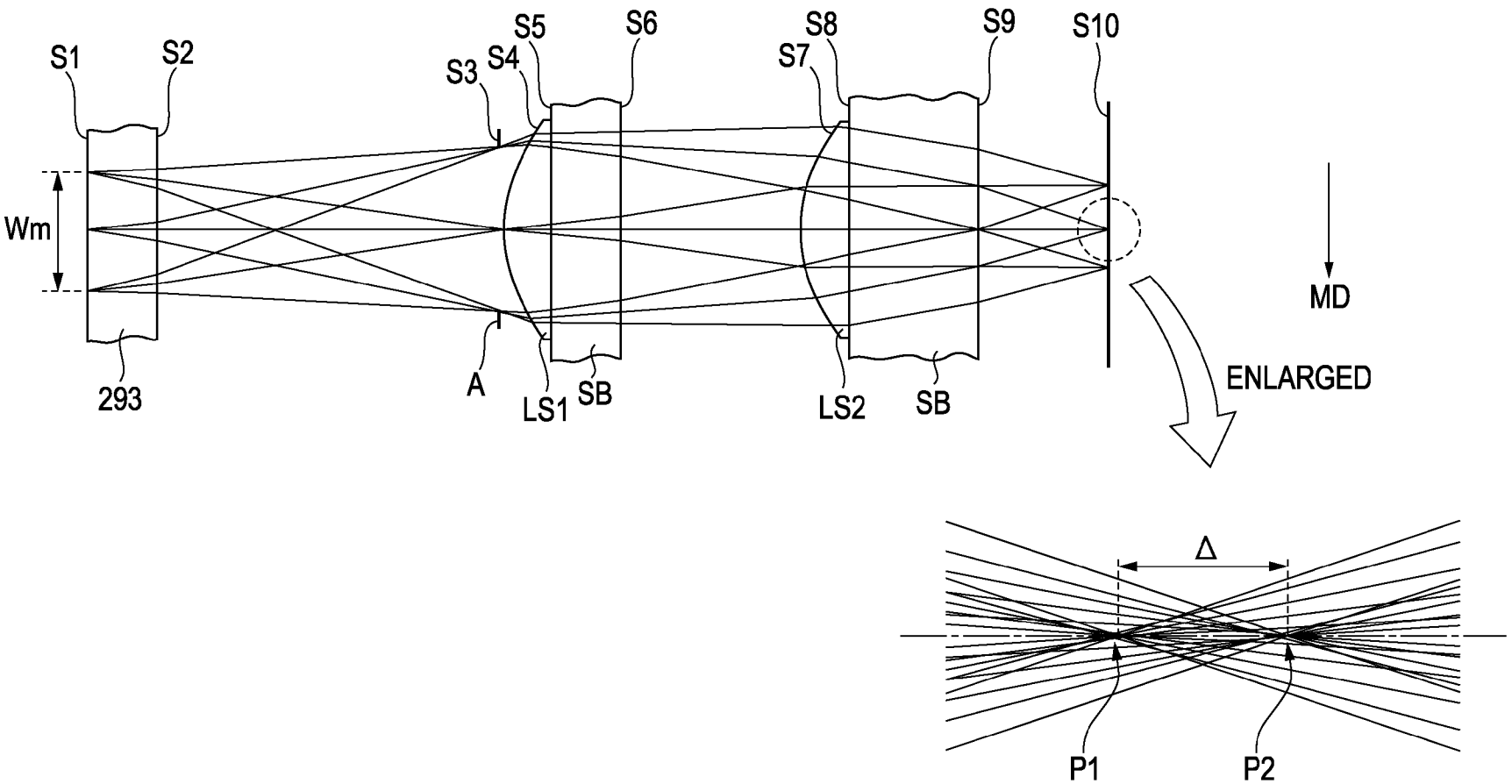
FIG. 18 is a sectional view illustrating light rays of an optical system taken in the main scanning direction.
Figure 19:
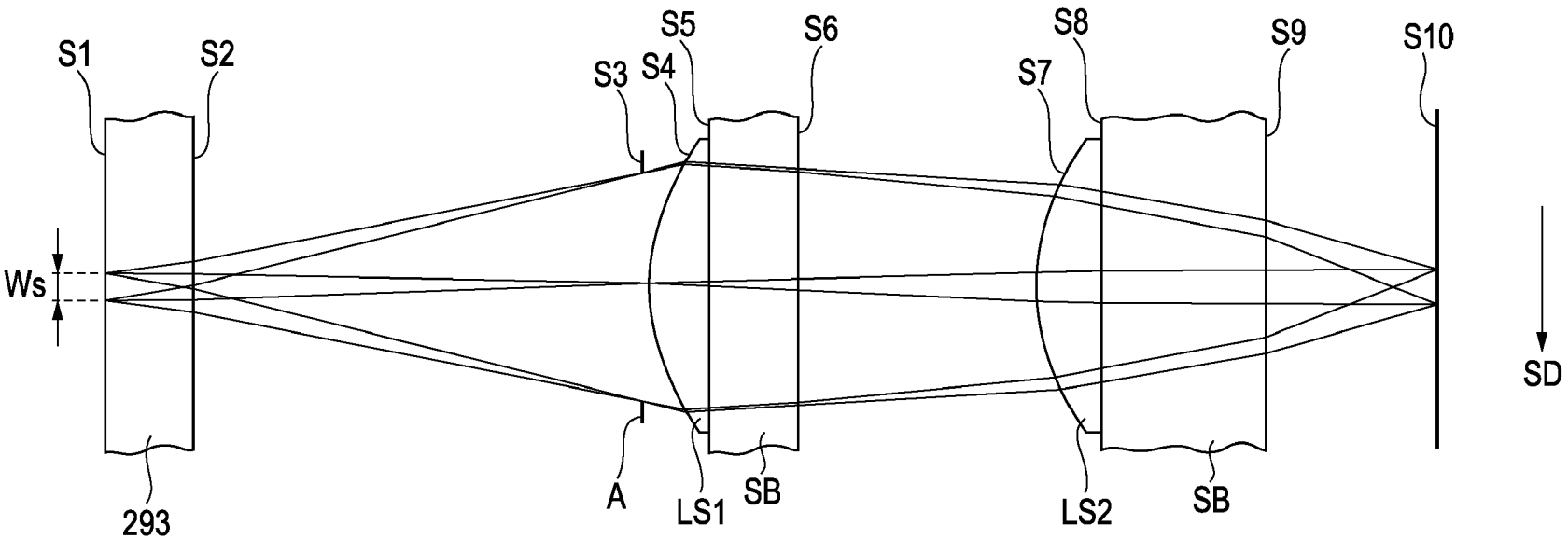
FIG. 19 is a sectional view illustrating light rays of the optical system taken in the sub-scanning direction.
Figures 20, 21:
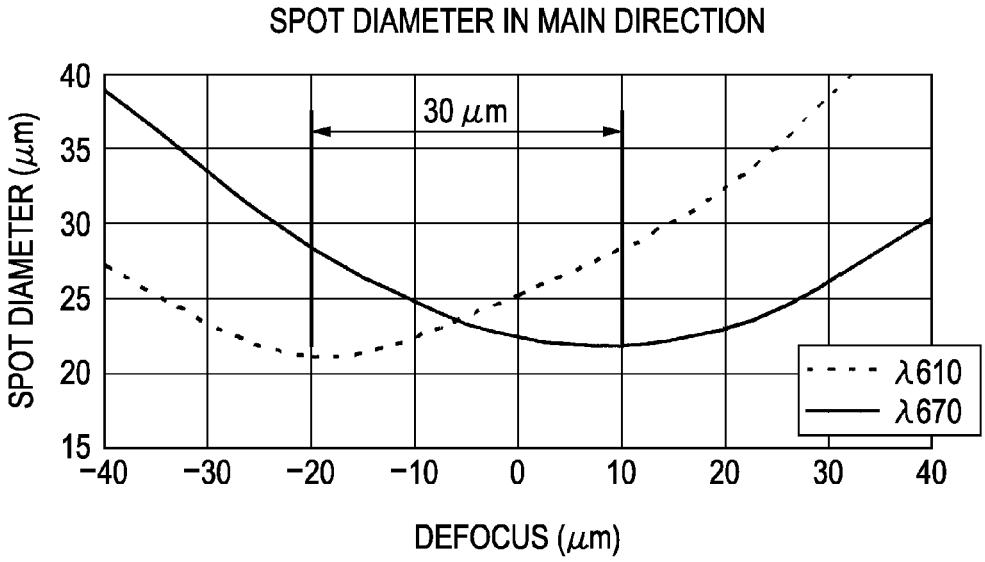
FIG. 20 is a table of specifications of the optical system used to obtain data of FIGS. 18 and 19.
FIG. 21 is a graph illustrating imaging positions of two light having different wavelengths obtained by performing a simulation.

FIG. 15 is lens data of an optical system used in the example. FIG. 16 shows summary data about the shape of a S4 surface. FIG. 17 shows summary data about the shape of a S7 surface. FIG. 18 is a sectional view illustrating light rays of an optical system taken in the main scanning direction. FIG. 19 is a sectional view illustrating light rays of the optical system taken in the sub-scanning direction. FIG. 20 is a table of specifications of the optical system used to obtain data of FIGS. 18 and 19. The ray diagrams of FIGS. 18 and 19 were obtained by using an optical system whose specifications, shown in FIG. 20, were as follows: the width of the object-side pixel group in the main direction (the width Wm in FIG. 18) was 0.885 mm, the width of the object-side pixel group in the sub-direction (Ws in FIG. 19) was 0.150 mm, the diameter D of the light emitting element was 28.6 μm, the object-side open angle (semi-angle) was 12.6°, the image-side angular aperture u (semi-angle) was 17.6°, and the magnification of the optical system was −0.7056.

As illustrated in lens data of FIGS. 15 to 17 and light ray diagrams of FIGS. 19 and 20, the optical system of the embodiment included two lenses. The two lenses were made of a lens material (resin) having a small Abbe number (vd=30). As a result, the optical system had a comparatively high chromatic aberration. Light emitted from the light emitting element and having an emission spectrum with peaks at two wavelengths (λ1 and λ2) was focused with the optical system having a high chromatic aberration. As illustrated in the enlarged view of FIG. 18, the light having the wavelength λ1 and the light having the wavelength λ2 were respectively focused at the imaging positions P1 and P2 that were separated from each other by a distance Δ in the optical axis direction. Thus, the apparent depth of focus of the optical system was made sufficiently larger than the distance d described above, whereby a good exposure was realized.

Next, a case in which the values in FIG. 1 were, R=50 mm, Bβ=0 mm, Bα=1.7 mm, and $d=(50^2-0^2)^{1/2}-(50^2-1.7^2)^{1/2}=0.0289$ mm will be specifically described.

Figure 22:
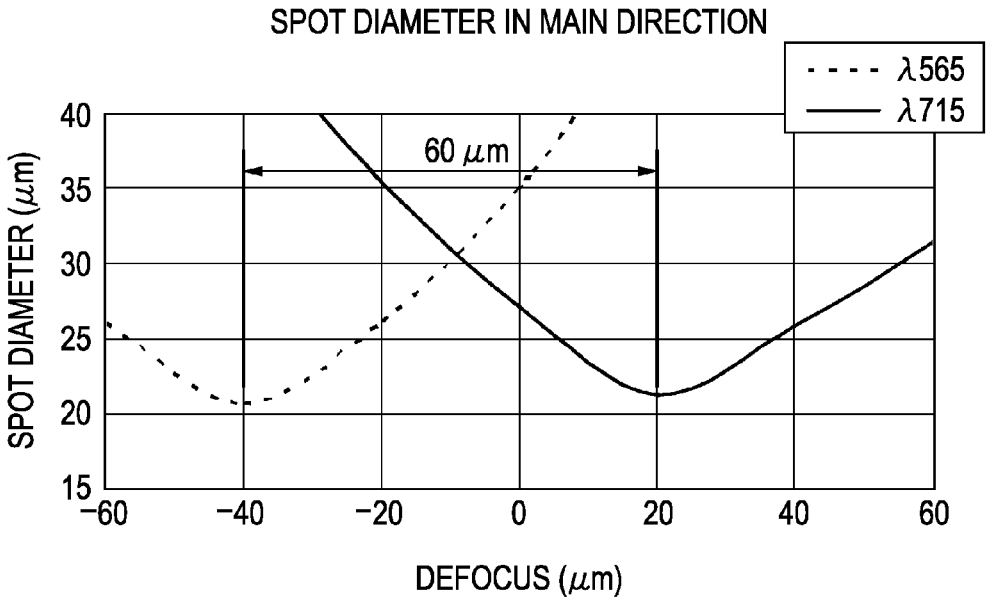
FIG. 22 is a graph illustrating imaging positions of two light having different wavelengths obtained by performing a simulation.

FIGS. 21 and 22 are graphs illustrating the imaging position of the light having the wavelength λ1 and the imaging position of the light having the wavelength λ2 obtained by performing a simulation. To be specific, FIG. 21 illustrates the diameter of a spot formed when the optical system used in the example converged the light having a wavelength λ1=610 nm to the spot (broken-line curve) and the diameter of a spot formed when the optical system used in the example converged the light having a wavelength λ2=670 nm to the spot (solid-line curve). FIG. 22 illustrates the diameter of a spot formed when the optical system used in the example converged the light having a wavelength λ1=565 nm to the spot (broken-line curve) and the diameter of a spot formed when the optical system used in the example converged the light having a wavelength λ2=715 nm to the spot (solid-line curve). In FIGS. 21 and 22, the horizontal axis represents the defocus (μm) and the vertical axis represents the spot diameter (μm). That is, these graphs illustrate variation of the diameter of the spot SP (the diameter in the main scanning direction) relative to the displacement (defocus) of the spot SP in the optical axis direction. The minimal point of the curve corresponds to the imaging position of a light having a wavelength corresponding to the curve.

As illustrated in FIG. 21, the imaging position of a light having the wavelength λ1 (=610 nm) and the imaging position of a light having the wavelength λ2 (=670 nm) were separated from each other by a distance of 30 μm in the optical axis direction Doa. That is, by using a light source that emitted a light having a wavelength of 610 nm and a light having a wavelength of 670 nm, the distance Δ between the imaging positions became 30 μm, whereby an effect was obtained in that the apparent depth of focus of the optical system was increased. As illustrated in FIG. 22, the imaging position of a light having the wavelength λ1 (=565 nm) and the imaging position of a light having the wavelength λ2 (=715 nm) were separated from each other by a distance 60 μm in the optical axis direction Doa. That is, by using a light source that emitted a light having a wavelength of 565 nm and a light having a wavelength of 715 nm, the distance Δ between the imaging positions became 60 μm, whereby an effect was obtained in that the apparent depth of focus of the optical system was increased.

Figure 23:
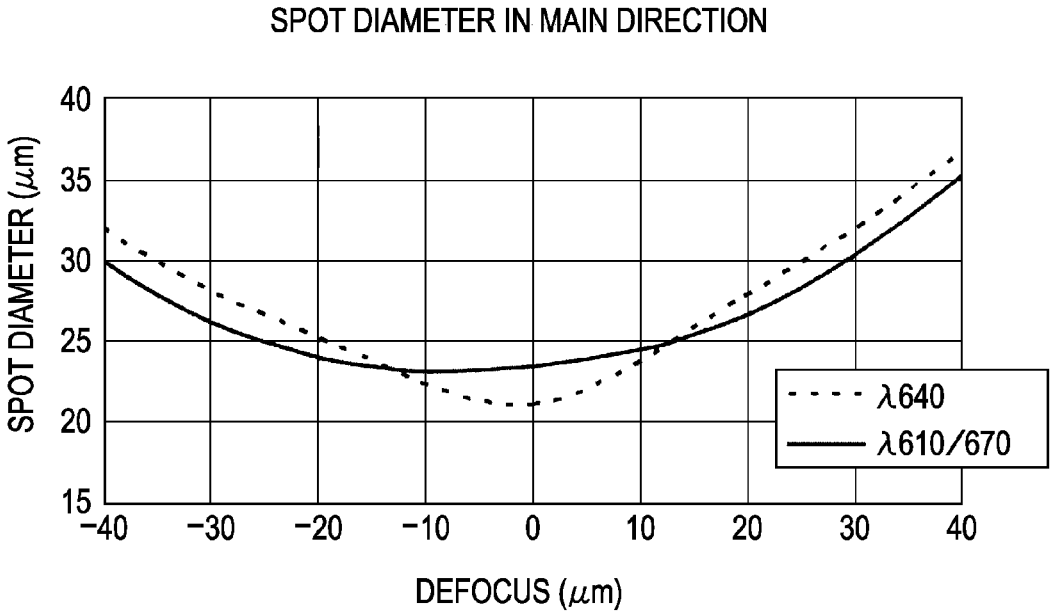
FIG. 23 is a graph illustrating an increase in the depth of focus of the optical system.
Figure 24:
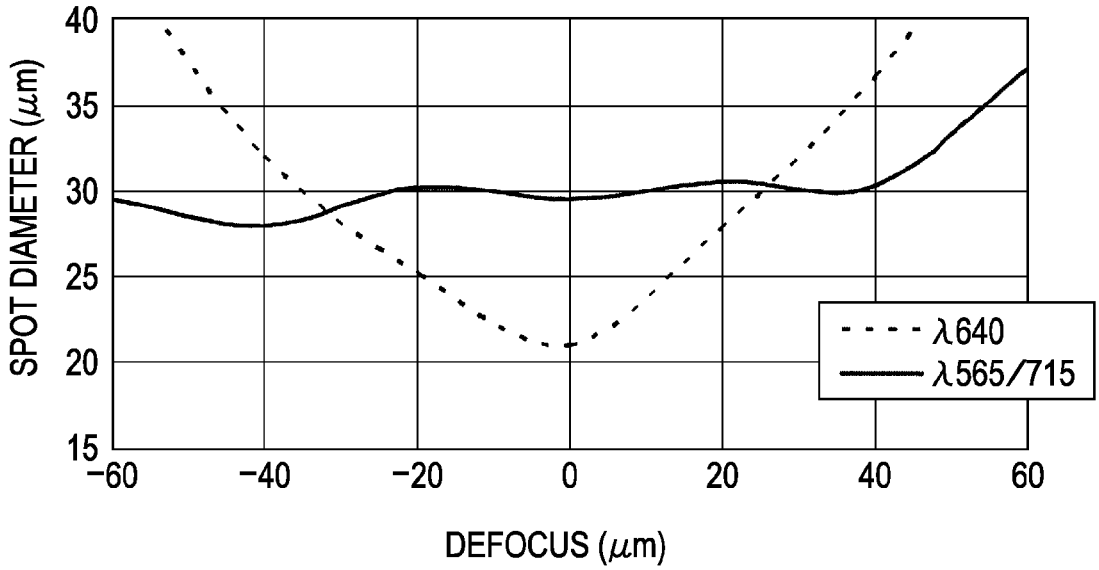
FIG. 24 is a graph illustrating an increase in the depth of focus of the optical system.

FIGS. 23 and 24 are graphs illustrating an increase in the depth of focus of the optical system, which were obtained by performing simulation. In FIGS. 23 and 24, the horizontal axis represents the defocus (μm) and the vertical axis represents the spot diameter (μm). That is, these graphs illustrate variation of the diameter of the spot SP (the diameter in the main scanning direction) relative to the displacement (defocus) of the spot SP in the optical axis direction. In FIG. 23, the spot formed by focusing a light having two wavelength components of 610 nm and 670 nm and the spot formed by focusing a light having a wavelength of 640 nm are compared with each other. In FIG. 24, the spot formed by focusing a light having two wavelength components of 565 nm and 715 nm and the spot formed by focusing a light having a wavelength of 640 nm are compared with each other.

The imaging position of the light having the wavelength of 610 nm and the imaging position of the light having the wavelength of 670 nm were displaced from each other in the optical axis direction by Δ=30 μm. Therefore, as illustrated in FIG. 23, when the light having the two wavelength components were focused, variation in the spot SP was smaller and the increase in the apparent depth of focus was larger than the case when the light having the wavelength of 640 nm was focused.

Likewise, the imaging position of the light having the wavelength of 565 nm and the imaging position of the light having the wavelength of 715 were displaced from each other in the optical axis direction by Δ=60 μm. Therefore, as illustrated in FIG. 24, when the light having the two wavelength components was focused, variation in the spot SP was smaller and the increase in the apparent depth of focus was larger than the case when the light having the wavelength of 640 nm was focused.

Moreover, in any of FIGS. 23 and 24 (FIGS. 21 and 22), the distance Δ between the imaging positions was equal to or larger than the distance d (=0.0289 mm). Therefore, the apparent depth of focus was made sufficiently larger than the distance d, whereby a good exposure could be realized.

This distance Δ satisfied the expression 2, so that influence on the imaging performance such as aberration was suppressed, whereby a better exposure could be realized. That is, the right hand side of the expression 2 was $$|-0.7056|\times 28.6\ \mu m/\tan(17.6°)=63.6\ \mu m.$$

The distance Δ (=30 μm, 60 μm) between the imaging positions illustrated in FIGS. 23 and 24 (FIGS. 21 and 22) was shorter than 63.6 μm.

The entire disclosure of Japanese Patent Applications No. 2009-147862, filed on Jun. 22, 2009 is expressly incorporated by reference herein.

What is claimed is:

1. An image forming apparatus comprising:

an image carrier having a curvature in a first direction; and an exposure head including a first light emitting element that emits a light having a wavelength λ11 and a light having a wavelength λ12, a first optical system that converges a light emitted from the first light emitting element onto the image carrier, a second light emitting element, and a second optical system that converges a light emitted from the second light emitting element onto the image carrier, wherein a position at which the first optical system converges light and a position at which the second optical system converges the light are different from each other with respect to the first direction, wherein the first optical system focuses the light having the wavelength λ11 at an imaging position P11 and focuses the light having the wavelength λ12 at an imaging position P12, the imaging position P11 and the imaging position P12 being different from each other with respect to an optical axis direction of the first optical system, and wherein a distance Δ1 between the imaging position P11 and the imaging position P12 with respect to the optical axis direction of the first optical system is equal to or larger than a distance d between an intersection point I1 and an intersection point I2 with respect to the optical axis direction of the first optical system, the intersection point I1 being a point at which the optical axis of the first optical system intersects the image carrier, the intersection point I2 being a point at which an optical axis of the second optical system intersects the image carrier, wherein the distance d is a positive number.

2. The image forming apparatus according to claim 1, wherein the first light emitting element has an emission spectrum having peaks at the wavelength λ11 and the wavelength λ12.

3. The image forming apparatus according to claim 1, further comprising:

an aperture diaphragm disposed in the first optical system, wherein an expression $$\Delta 1 \leqq |m| \times D/\tan(u)$$

is satisfied, where D is a diameter of the first light emitting element with respect to a second direction that is perpendicular to the first direction, m is a magnification of the first optical system with respect to the second direction, and u is an image-side angular aperture that is half an angle between two lines connecting an image point of the first optical system and ends of a diameter of an entrance pupil.

4. The image forming apparatus according to claim 1, wherein the second light emitting element emits a light having a wavelength λ21 and a light having a wavelength λ22, wherein the second optical system focuses the light having the wavelength λ21 at an imaging position P21 and focuses the light having the wavelength λ22 at an imaging position P22, the imaging position P21 and the imaging position P22 being different from each other with respect to the optical axis direction of the second optical system, and wherein a distance Δ2 between the imaging position P21 and the imaging position P22 with respect to the optical axis direction of the second optical system is equal to or larger than the distance d.

5. The image forming apparatus according to claim 1, wherein three or more optical systems including the first optical system and the second optical system are arranged in the first direction, the three or more optical system converging light at different positions with respect to the first direction, and wherein one of the optical axis of the first optical system and the optical axis of the second optical system is nearest to a center of curvature of the image carrier among optical axes of the three or more optical systems, and the other of the optical axis of the first optical system and the optical axis of the second optical system is farthest from the center of curvature of the image carrier among the optical axes of the three or more optical systems.

6. The image forming apparatus according to claim 5, wherein (2N+2) optical systems (where N is an integer equal to or greater than 1) including the first optical system and the second optical system are arranged in the first direction with a distance therebetween, and wherein the one of the first optical system and the second optical system is located in an (N+1)th or an (N+2)th position from an end of the (2N+2) optical systems.

7. The image forming apparatus according to claim 5, wherein (2N+1) optical systems (where N is an integer equal to or greater than 1) including the first optical system and the second optical system are arranged in the first direction with a distance therebetween, and wherein the one of the first optical system and the second optical system is located in an (N+1)th position from an end of the (2N+1) optical systems.

8. An exposure head comprising:

a first light emitting element that emits a light having a wavelength $\lambda 11$ and a light having a wavelength $\lambda 12$;

a first optical system that converges a light emitted from the first light emitting element onto an exposure surface having a curvature in a first direction;

a second light emitting element; and a second optical system that converges a light emitted from the second light emitting element onto the exposure surface, wherein a position at which the first optical system converges the light and a position at which the second optical system converges the light are different from each other with respect to the first direction, wherein the first optical system focuses the light having the wavelength $\lambda 11$ at an imaging position P11 and focuses the light having the wavelength $\lambda 12$ at an imaging position P12, the imaging position P11 and the imaging position P12 being different from each other with respect to an optical axis direction of the first optical system, and wherein a distance $\Delta 1$ between the imaging position P11 and the imaging position P12 with respect to the optical axis direction of the first optical system is equal to or larger than a distance d between an intersection point I1 and an intersection point I2 with respect to the optical axis direction of the first optical system, the intersection point I1 being a point at which the optical axis of the first optical system intersects the exposure surface, the intersection point I2 being a point at which an optical axis of the second optical system intersects the exposure surface, wherein the distance d is a positive number.

* * * * *